US005201291A

United States Patent [19]

Katoh et al.

[11] Patent Number: 5,201,291

[45] Date of Patent: Apr. 13, 1993

[54] THROTTLE VALVE CONTROLLER

[75] Inventors: Yukiya Katoh; Takeru Yasuda; Sunao Kitamura, all of Obu, Japan

[73] Assignee: Aisan Kogyo Kabushiki Kaisha, Aichi, Japan

[21] Appl. No.: 933,361

[22] Filed: Aug. 21, 1992

[30] Foreign Application Priority Data

Aug. 21, 1991 [JP] Japan ..... 3-235501
Nov. 15, 1991 [JP] Japan ..... 3-328108

[51] Int. Cl.[5] ..... F02D 7/00
[52] U.S. Cl. ..... 123/399
[58] Field of Search ..... 123/399, 397, 400

[56] References Cited

U.S. PATENT DOCUMENTS 5,117,791 6/1992 Chan et al. ..... 123/399
5,121,727 6/1992 Kramer et al. ..... 123/399
5,134,979 8/1992 Pfalzgraf ..... 123/399
5,161,506 11/1992 Mausnor et al. ..... 123/399

FOREIGN PATENT DOCUMENTS 1-227825 9/1989 Japan .
1-173355 12/1989 Japan .

*Primary Examiner*—Raymond A. Nelli
*Attorney, Agent, or Firm*—Dennison, Meserole, Pollack & Scheiner

[57] ABSTRACT

A throttle valve controller for an engine includes a throttle valve pivotally movable along with a throttle shaft in an intake passage of the engine, an electronic control transmission path for transmitting input torque to the throttle shaft, an electromagnetic actuator for applying torque to the electronic control transmission path, a mechanical control transmission path for transmitting manipulation force of an accelerator pedal to the throttle shaft, and switching means for connecting one of the electronic control and mechanical control transmission paths and disconnecting the other.

9 Claims, 26 Drawing Sheets

THROTTLE VALVE CONTROLLER

BACKGROUND OF THE INVENTION

1. Field of the Invention

Recently, a throttle valve controller for an engine, especially a vehicular throttle valve controller has been required to satisfy various requirements, and some of such requirements are as follows:

(1) If any slippage of a wheel occurs, the throttle valve must be actuated toward its closed position, regardless of depression of an accelerator pedal, so as to eliminate the slippage:

(2) Opening and closing of the throttle valve must be controlled based on the modified manipulated amount of the accelerator pedal in response to the driving condition of the engine;

(3) The throttle valve must be controlled so as to obtain a constant vehicle speed, regardless of the manipulated amount of the accelerator pedal by a driver; and (4) During shifting of an automatic transmission, the throttle valve must be actuated toward its closed position.

In order to satisfy these various requirements, there has been proposed an apparatus wherein the throttle valve is controlled by an electromagnetic actuator. Such an electromagnetic actuator is effective to meet the above requirements (1) to (4). However, such an electromagnetic actuator and a control unit therefor may suffer from a breakdown. To assure safety, there has been developed a throttle valve controller which is provided, in addition to the electromagnetic actuator, with a mechanical control transmission path for mechanically transmitting depressed force of the accelerator pedal to a throttle shaft. The present invention relates to a throttle valve controller of this type.

2. Description of the Prior Art

In order to meet the above requirements (1) to (4) in such a throttle valve controller, the electromagnetic actuator and the mechanical control transmission path must be switched to control opening and closing of the throttle valve. For this purpose, there has been proposed a prior art system as shown in FIG. 26, which is disclosed in Japanese Laid-Open Utility Model Publication No. 1-173355.

The prior art system in FIG. 26 includes a throttle valve 60 for adjusting the amount of intake air to an engine, bias means 61 for normally biasing the throttle valve 60 toward its closed position, an electromagnetic actuator 64 for controlling opening and closing of the throttle valve 60 in accordance with a control signal generated from a control circuit 63 in response to the depressed amount of an accelerator pedal 62, an electronic control transmission path 67 for transmitting driving force of the actuator 64 to a throttle shaft 65 of the throttle valve 60, a mechanical control transmission path 68 for mechanically transmitting manipulated force of the accelerator pedal 62 to the throttle shaft 65, a first switching means 51 for connecting or disconnecting the electronic control transmission path 67, and a second switching means 52 for connecting or disconnecting the mechanical control transmission path 68.

In the normal operating condition, only the first switching means 51 is activated to connect the electronic control transmission path 67, allowing normal driving, while, in the abnormal operating condition, only the second switching means 52 is activated to connect the mechanical control transmission path 68, allowing a vehicle to run off the road. The switching means 51, 52 are switched for activation in response to absence or presence of a malfunction signal from the control circuit 63.

In the above prior apparatus, the transmission paths 67 and 68 employ their individual switching means to switch disconnection and connection thereof, so that the two switching means 51, 52 are required, which increases complication in structure and cost.

Provision of the two switching means 51, 52 further involves a possibility of simultaneous connection of both transmission paths 67, 68 when both switching means 51, 52 are activated in error, and in such a case, the throttle valve 60 will become uncontrollable, which causes a defect in reliability.

FIG. 27 shows another prior art system as shown in Japanese Laid-Open Patent Publication No. 1-227825. In this system, a throttle valve 72 has a throttle shaft 73 to which an arm 74 is attached and has an end rotatably supporting a sheave 77 through a pin 75. A return spring (not shown) is attached to the other end of the arm 74 so as to bias the throttle valve 72 toward its closed position. The sheave 77 has a groove in which a cable 78 is trained, the cable having one end coupled with a pulley 80 through a pin and the other end coupled with an accelerator pedal 81. The pulley 80 has a rotary shaft 85 which is connected through an electromagnetic clutch 86 to an output shaft of a motor 87. The motor 87 is controlled by an electronic control unit 97 in accordance with the driving condition of a vehicle.

In the regular or normal operating condition, opening and closing of the throttle valve 72 is directly manipulated by the accelerator pedal 81 through the cable 78, and during traction control or shifting by an automatic transmission, the motor 87 drives the pulley 80 to close the throttle valve 72 irrespective of depression of the accelerator pedal 81. In the faulty or abnormal operating condition, the electromagnetic clutch 86 is turned off to disconnect the motor 87, permitting control of the throttle valve 72 only by the accelerator pedal 81.

In this system, the mechanical control transmission path is kept in connection both in the normal and abnormal operating conditions, and the electromagnetic actuator is used only to close the throttle valve 72 for traction control or the like. Thus, this system can meet the above requirements (1) and (4) but not the other requirements (2) and (3).

In the prior art apparatus in FIG. 27, the electromagnetic clutch 86 is not provided on the throttle shaft 73 of the throttle valve 72 but on the rotary shaft 85 disposed apart from the throttle shaft 73, so that there must be provided between the throttle shaft 73 and the rotary shaft 85 the power transmission mechanism composed of the sheave 77, the pulley 80, the cable 78 and others. This increases complication in structure and the number of parts, causing enlargement in size of the apparatus and reduction of reliability thereof.

Furthermore, the apparatus is so constructed as to cause interference between two valve driving systems of an accelerator system (mechanical control transmission path) and a motor system (electronic control transmission path), which will deteriorate electronic controllability in the normal operating condition as well as accelerating manipulability due to change in the depressed force of the accelerator pedal caused by reaction force thereof.

SUMMARY OF THE INVENTION

Accordingly, it is an object of the present invention to provide a throttle valve controller which permits positive switching between a position wherein the electronic control transmission path is connected but the mechanical control transmission path is disconnected, and a position wherein the electronic control transmission path is disconnected but the mechanical control transmission path is connected, so as to preclude possible simultaneous connection of both of the transmission paths in the event of any malfunction.

Another object of the present invention is to provide a throttle valve controller which permits positive switching to a position wherein the electronic control transmission path is disconnected but the mechanical control transmission path is connected, in the event of any malfunction.

A further object of the present invention is to provide a throttle valve controller having a relatively simplified construction.

The above objects of the present invention are accomplished by providing a throttle valve controller for an engine comprising a throttle valve pivotally movable along with a throttle shaft in an intake passage of the engine, an electronic control transmission path for transmitting input torque to the throttle shaft, an electromagnetic actuator for applying torque to the electronic control transmission path, a mechanical control transmission path for transmitting manipulation force of an accelerator pedal to the throttle shaft, and switching means for connecting one of the electronic control and mechanical control transmission paths and disconnecting the other. In this throttle valve controller of the above construction, simultaneous connection or disconnection of both of the electronic control and mechanical control transmission paths is positively precluded.

According to a aspect of the present invention, the electronic control and mechanical control transmission paths of the throttle valve controller are disposed coaxially of the throttle shaft, with a clutch plate provided axially displaceably therebetween. The switching means includes a solenoid for axially displacing the clutch plate. Axial displacement of the clutch plate allows switching between a position wherein the electronic control transmission path is connected but the mechanical control transmission path is disconnected, and a position wherein the electronic control transmission path is disconnected but the mechanical control transmission path is connected. In this throttle valve controller of this construction, the clutch plate is effective to positively switch the transmission path to be connected.

The invention will be more fully understood from the following detailed description of preferred embodiments and appended claims when taken with the drawings.

DETAILED DESCRIPTION OF THE PREFERRED EMBODIMENTS

Figure 1:
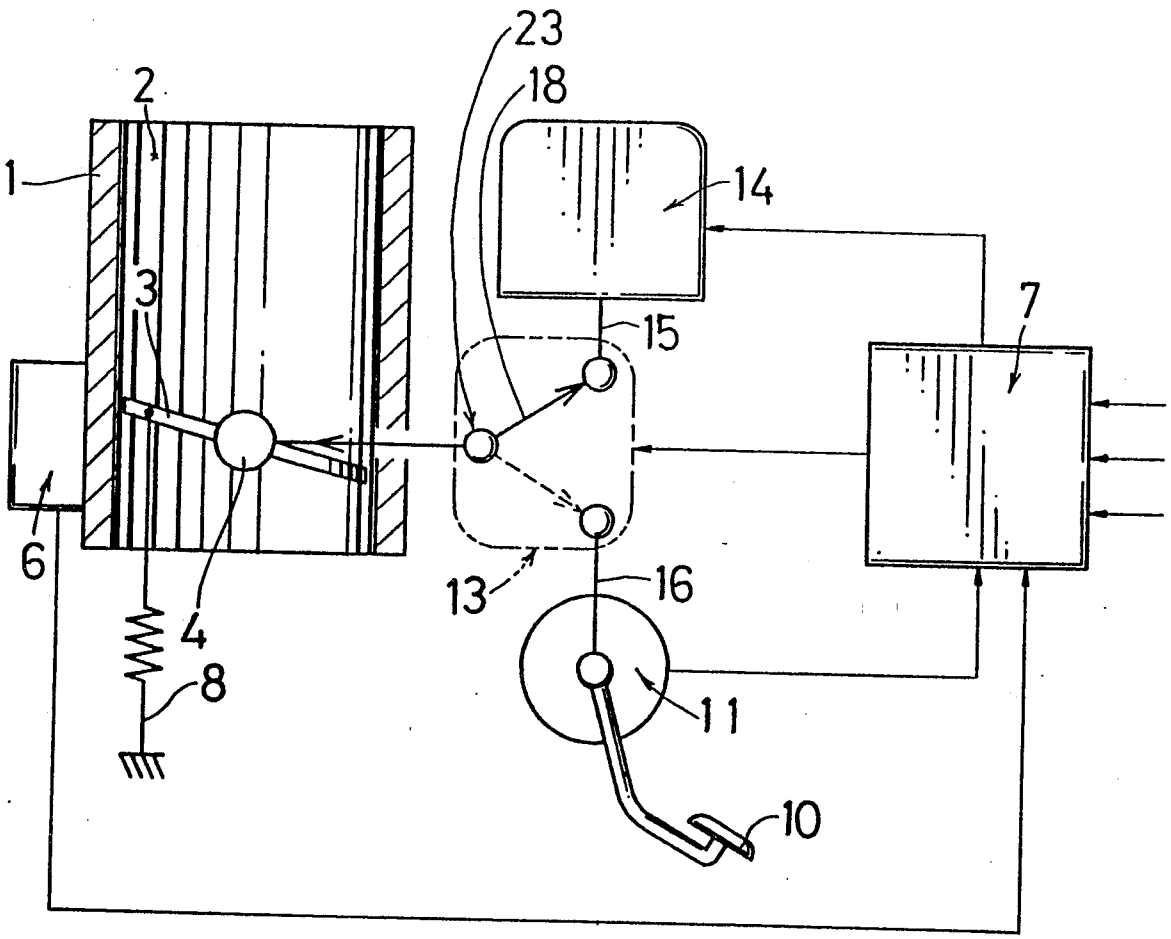
FIG. 1 is a schematic view of a throttle valve controller according to a first embodiment of the present invention.

Referring to the drawings and to FIGS. 1 to 7 in particular, shown therein is a throttle valve controller constructed in accordance with a first embodiment of the present invention.

As shown in FIG. 1, a throttle body 1 in an engine for a vehicle or the like is provided with a throttle valve 3 disposed therein for opening or closing an intake passage 2 so as to adjust the amount of intake air to the engine. The throttle valve 3 is affixed to a throttle shaft 4 having opposite ends pivotally movably supported by the throttle body 1.

A throttle sensor 6 is provided on a side (left side as viewed in FIG. I) of the throttle body 1. The sensor 6 is adapted to detect the opening degree of the throttle valve 3 from the amount of pivotal movement of the throttle shaft 4, and to transmit a detection signal to a control circuit 7 composed of an electronic control unit ECU).

The throttle valve 3 is provided with a return spring 8 adapted to normally bias the throttle valve 3 to its closed position. Specifically, as shown in section in FIG. 2, the throttle shaft 4 has an end (left end as viewed in FIG. 2) to which a throttle sensor lever 9 is attached so as to be engageable with a detecting element of the throttle sensor 6, and the return spring 8 is disposed in double layer between the lever 9 and the throttle body 1.

An accelerator pedal 10 is disposed on a floor of a driver's seat of the vehicle so as to be manipulated by depression. The depressed amount of the pedal 10 is detected by an accelerator sensor 11, and the detection signal is transmitted to the control circuit 7.

The throttle shaft 4 is connected at the other end thereof to an electromagnetic actuator 14 composed of a step motor through switching means 13. The electromagnetic actuator 14 is operative to control opening and closing of the throttle valve 3 in response to a control signal from the control circuit 7. The control circuit 7 is adapted to control activation of the electromagnetic actuator 14 in accordance with the manipulated or depressed amount of the accelerator pedal 10 and the running condition of the engine, and more specifically, it receives detection signals from the throttle sensor 6, the accelerator sensor 11 and other sensors not shown) such as a vehicle speed sensor for detecting the vehicle speed and an engine speed sensor, and transmits a control signal to the electromagnetic actuator 14 in accordance with these detection signals. Further, the control circuit 7 transmits a malfunction signal to a switching actuator 23 (which will be mentioned later) in the switching means 13 in the event of a malfunction in the control circuit itself or other abnormalities such as motor locking of the electromagnetic actuator 14 and gear locking.

The switching means 13 is adapted to selectively connect an electronic control transmission path 15 for transmitting driving force of the electromagnetic actuator 14 to the throttle shaft 4 or a mechanical control transmission path 16 for transmitting manipulated force of the accelerator pedal 10 to the throttle shaft 4. In the normal operating condition, it connects the electronic control transmission path 15 but disconnects the mechanical control transmission path 16. In the abnormal operating condition, it disconnects the electronic control transmission path 15 and connects the mechanical control transmission path 16, in response to a malfunction signal from the control circuit 7.

Figure 4A:
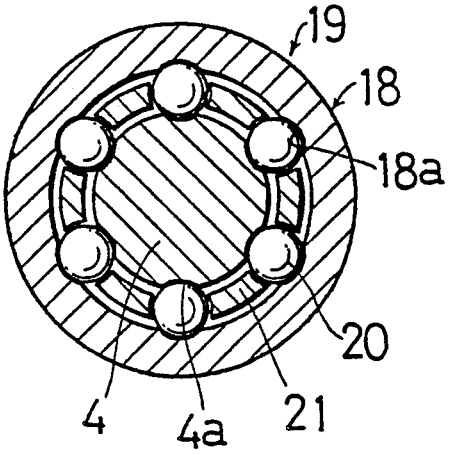
FIGS. 4(*a*) and 4(*b*) illustrative views of a ball spline structure.
Figure 4B:
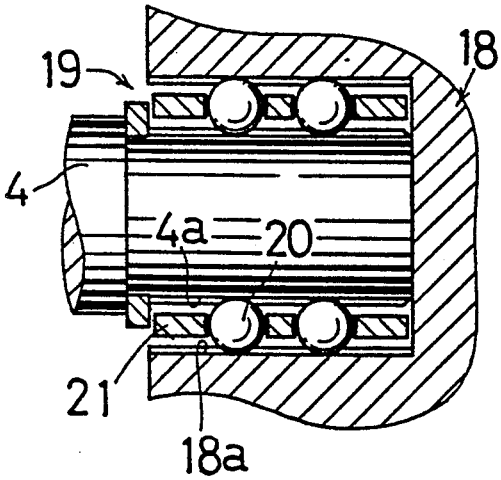
Figure 6:
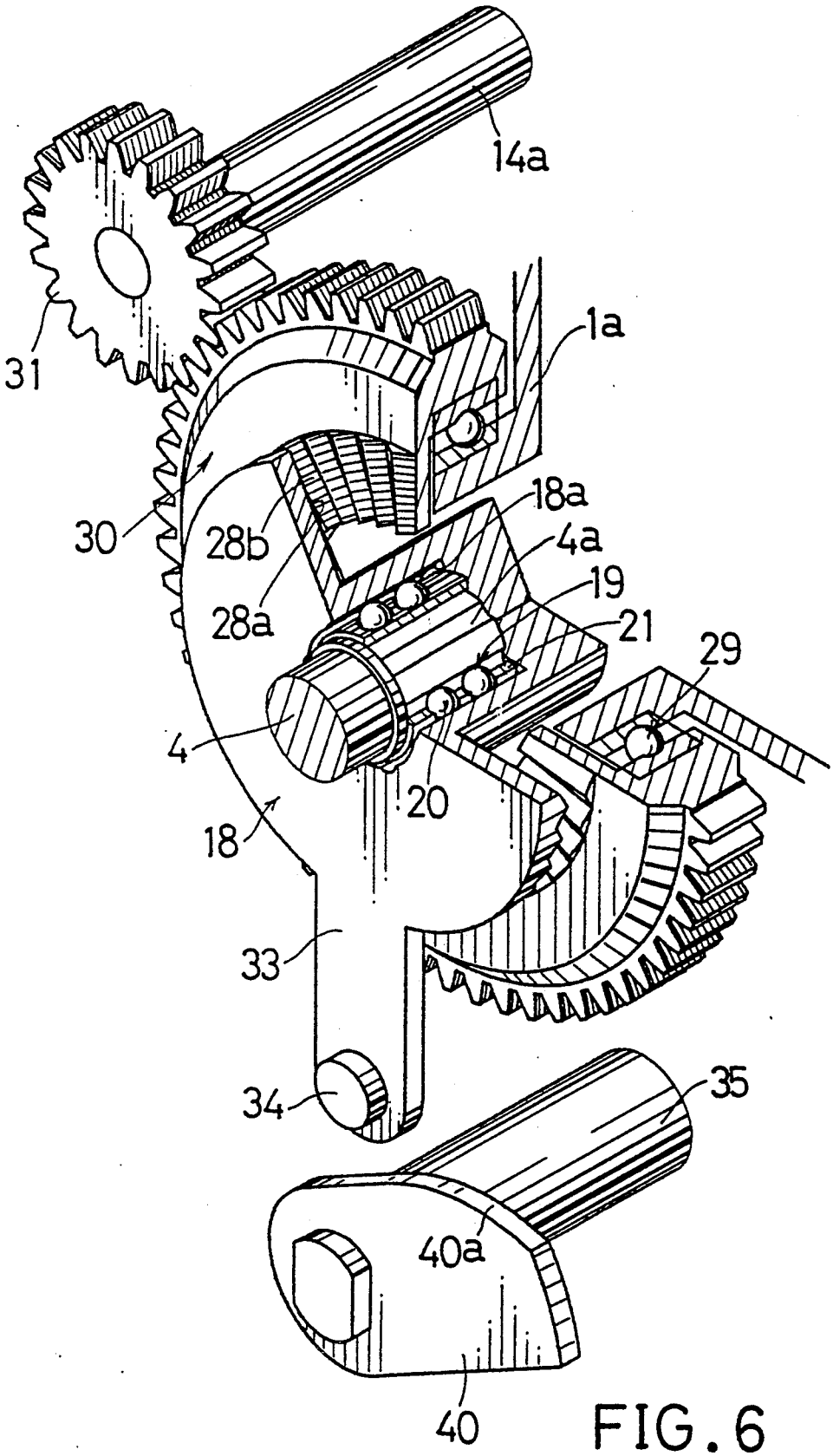
FIG. 6 is a perspective view, partly broken away, of a switching means.
Figure 7A:
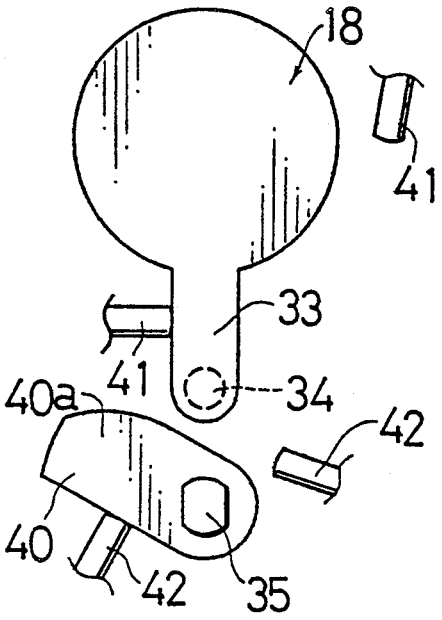
FIGS. 7(*a*)–7(*d*) are operational views of a mechanical control transmission path.
Figure 7B:
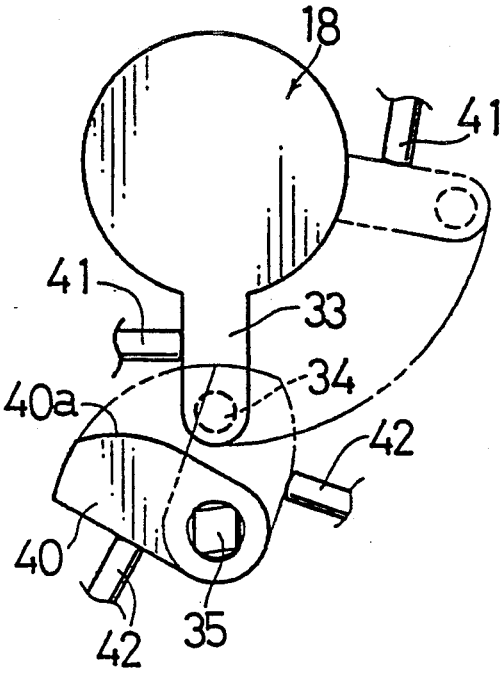
Figure 7C:
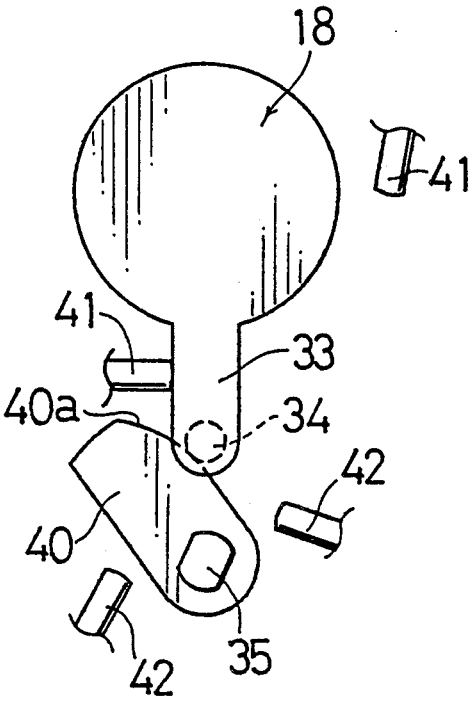
Figure 7D:
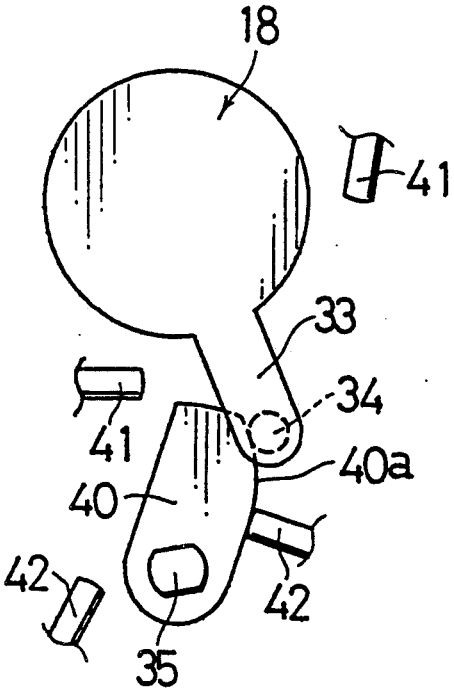

Now, the switching means 13 will be described more in detail as to its construction. As shown in FIG. 6 in addition to FIG. 2, an input switching clutch plate 18 of a substantially semicircular contour is mounted on the end of the throttle shaft 4 through a ball spline structure 19 in a manner displaceable in the thrust direction in relation to the throttle shaft 4 and integrally rotatable therewith. As shown in FIGS. 4(*a*) and 4(*b*), the ball spline structure 19 comprises balls 20 rotatably inserted between an outer spline grooves 4*a* formed in the throttle shaft 4 and corresponding inner spline grooves 18*a* formed in the input switching clutch plate 18 and held by retainers 21. The ball spline structure 19 is effective to smoothly displace the input switching clutch plate 18 in the thrust direction.

Figure 5A:
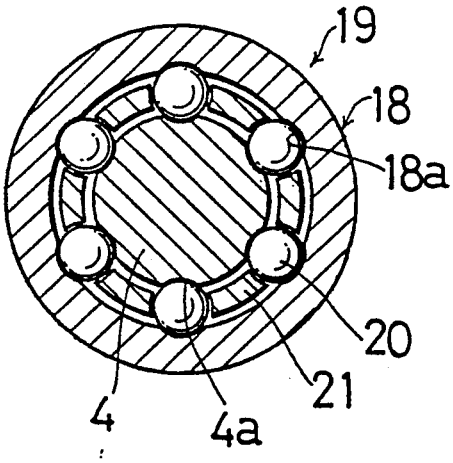
FIGS. 5(*a*) and 5(*b*) illustrative views of the ball spline structure in FIG. 4 but in the normal operating condition.
Figure 5B:
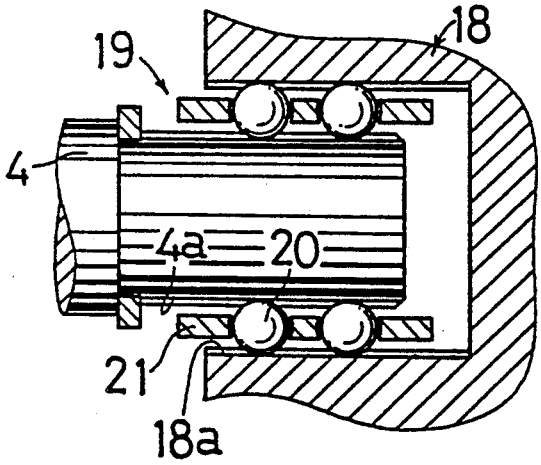

The input switching clutch plate 18 can be displaced by a switching actuator 23 which will be mentioned later between a first position shown in FIG. 4(*b*) and a second position displaced to the right (as viewed in the drawing) from the first position and shown in FIG. 5(*b*). FIGS. 4(*a*) and 5(*a*) are cross sectional views of the ball spline structure 19, and FIGS. 4(*b*) and 5(*b*) are longitudinal sectional views thereof.

Figure 2:
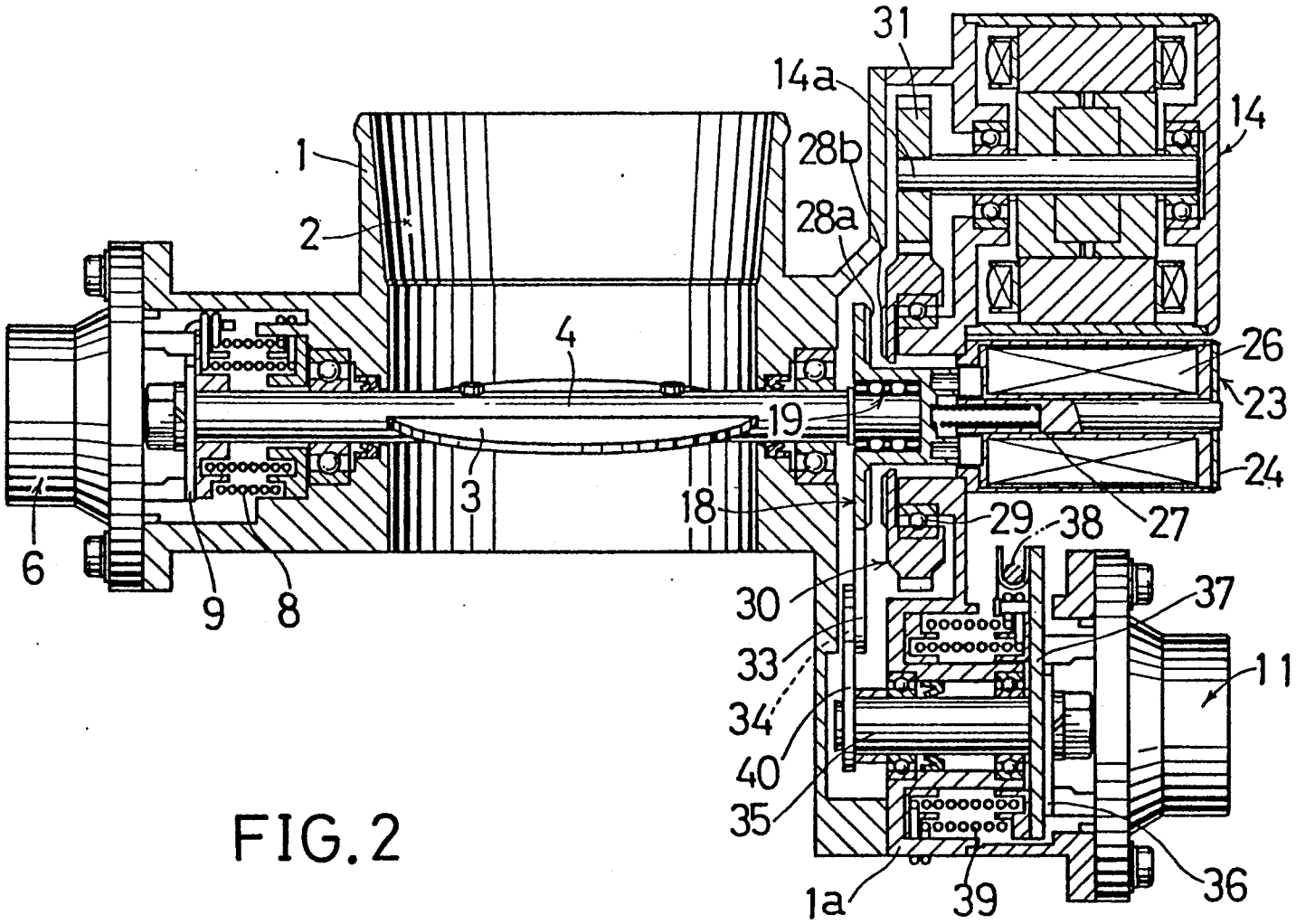
FIG. 2 is a sectional view showing the essential parts of the throttle valve controller of the first embodiment.

As shown in FIG. 2, a switching actuator 23 composed of solenoid is disposed coaxially of the input switching plate 18 and extends outwardly (to the right as viewed in FIG. 2) therefrom. The switching actuator 23 is installed in an adapter Ia secured to the throttle body 1 and has a moving element constituted by the input switching clutch plate 18. The switching actuator 23 includes a coil 26 in a case 24, and when there is no supply of electric power to the coil 26, or when it is not energized, the input switching clutch plate 18 is held in its first position by the biasing force of a spring 27 provided in the switching actuator 23, as shown in FIG. 2. When the coil 26 is energized, magnetic force is generated around the coil 26, causing the input switching clutch plate 18 to be displaced to its second position against the biasing force of the spring 27, as shown in FIG. 3.

As shown in FIGS. 2 and 6, the input switching clutch plate 18 has on the outer end surface thereof concentrically formed clutch teeth 28*a*, which are engageable with corresponding clutch teeth 28*b* formed on a transmission gear 30 rotatably supported by the adapter 1*a* through a bearing 29.

Figure 3:
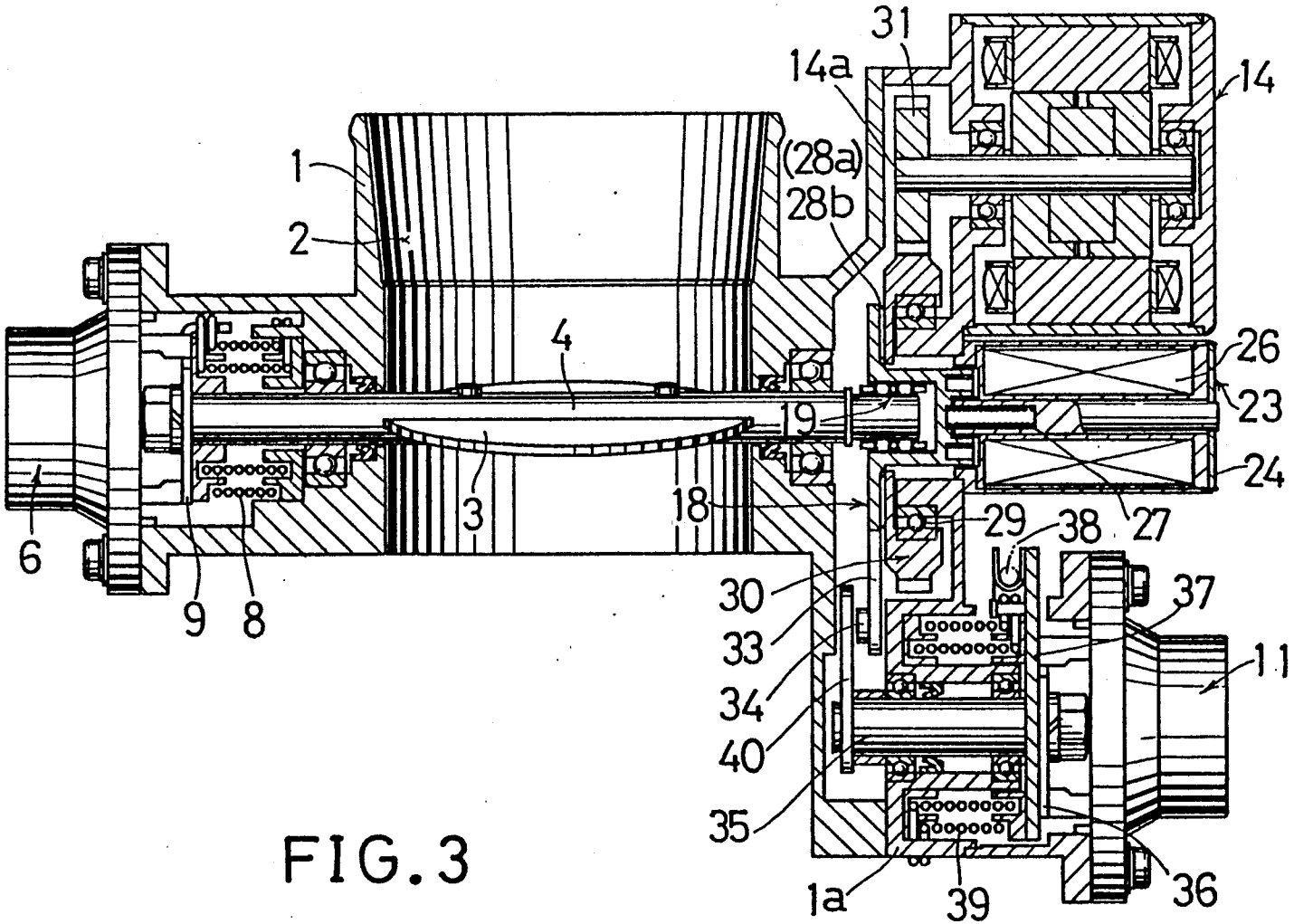
FIG. 3 is a view similar to FIG. 2 in the normal operating condition.

The clutch teeth 28*a* and 28*b* are so configured that, when both are engaged with each other to transmit torque, a thrust component of the torque is applied in such a direction as to disengage the input switching clutch plate 18 (to the left as viewed in FIG. 3).

Therefore, when the switching actuator 23 is energized and torque is being transmitted, sudden interruption of power supply to the actuator 23 results in rapid displacement of the input switching clutch plate 18 and consequently disengagement of the clutch teeth 28*a* and 28*b*.

The force generated when the switching actuator 23 is energized to attract the input switching clutch plate 18 is set to be greater than the resultant force of the thrust component applied during transmission of the torque and the biasing force of the spring 27.

The transmission gear 30 is in mesh with a motor gear 31 fixedly mounted on a motor shaft 14*a* of the electromagnetic actuator 14. Thus, when the electromagnetic actuator 14 is activated, the transmission gear 30 is rotated through the motor gear 31. The electromagnetic actuator 14 is installed in the adapter 1*a*.

As shown in FIG. 2, the adapter 1*a* further includes an accelerator sensor 11 adjacent to the switching actuator 23, and a pivot shaft 35 rotatably supported and extending coaxially of the sensor 11. An accelerator sensor lever 36 engageable with a detecting element of the accelerator sensor 11 and an accelerator lever 37 are attached to an end (right end as viewed in FIG. 2) of the pivot shaft 35.

An accelerator cable 38 extending from the accelerator pedal 10 is connected to the accelerator lever 37. A return spring 39 is provided in double layer between the accelerator lever 37 and the adapter 1*a* to normally has the lever 37 in the returned direction.

As shown in FIGS. 2 and 6, the input switching clutch plate 18 is formed with an interlocking piece 33 projecting downwardly as viewed in FIG. 6. The interlocking piece 33 has an interlocking pin 34 projecting inwardly (to the left as viewed in FIG. 6) thereof.

An interlocking lever 40 is attached to the other end of the pivot shaft 35, and has an extreme end which is engageable with a side (left side as viewed in FIG. 7) of the interlocking pin 34 in a direction opposite to the valve opening direction through pivotal movement of the interlocking lever 40 caused by depressed manipulation of the accelerator pedal 10, when the input switching clutch plate 18 is in its first position as shown in FIG. 2. When the input switching clutch plate 18 in its second position as shown in FIG. 3, such pivotal movement of the interlocking lever 40 results in swinging movement without engagement with the interlocking pin 34 (See two-dot chain lines in FIG. 7(*b*)).

The interlocking lever 40 has a cam surface 40*a* at a portion which is brought in abutment with the interlocking pin 34. The throttle body 1 or the adapter 1*a* includes stoppers 41 for limiting the range of pivotal movement of the input switching clutch plate 18 and stoppers 42 for limiting the range of pivotal movement of the interlocking lever 40, as shown in FIG. 7.

The throttle valve controller of this construction operates as follows.

In the normal operating or regular driving condition, the switching means 13 is in the position as shown in FIG. I. Specifically, the switching actuator 23 is energized, so that, as shown in FIG. 3, the input switching clutch plate 18 mounted on the throttle shaft 4 is in its second position where the clutch teeth 28*a* is in mesh with the clutch teeth 28*b* on the transmission gear 30.

When the accelerator pedal 10 is not depressed, the throttle valve 3 is biased to its fully closed position by the return spring 8, with the accelerator pedal 10 kept in its returned position under the biasing force of the return spring 39. In this condition, the input switching clutch plate 18 and the interlocking lever 40 are relatively positioned as shown in FIG. 7(*a*).

In this condition, when the accelerator pedal 10 is depressed, the electromagnetic actuator 14 is energized in accordance with the control signal produced by the control circuit 7 in response to the depressed amount, and generates driving force which is sequentially transmitted through the transmission gear 30, the input switching clutch plate 18 and the ball spline structure 19 to the throttle shaft 4 to open the throttle valve 3. This transmission path defines the electronic control transmission path 15. The depressed force of the accelerator pedal 10 is also transmitted to the interlocking lever 40 through the accelerator cable 38 in FIG. 3, but, in this case, the lever 40, being out of engagement with the interlocking pin 34 of the input switching clutch plate 18, swings as shown in the two-dot chain lines in FIG. 7(*b*).

If any malfunction occurs in the electromagnetic actuator 14, the control circuit 7 or others, the control circuit 7 transmits a malfunction signal to the switching actuator 23 of the switching means 13. This causes the switching actuator 23 to be deenergized, so that the input switching clutch plate 18 is displaced to its first position under the biasing force of the spring 27, as shown in FIG. 2. Thus, the clutch teeth 28*a* and 28*b* are disengaged, so that the electronic control transmission path 15 is disconnected. The input switching clutch plate 18 is now in a position wherein the interlocking pin 34 is engageable with the interlocking lever 40.

In this condition, when the accelerator pedal 10 is depressed, the interlocking lever 40 is pivotally moved from the position in FIG. 7(*a*) in the right direction (as viewed in the drawing) to a position in FIG. 7(*c*) wherein the cam surface 40*a* is brought in abutment with the interlocking pin 34, and then to a position in FIG. 7(*d*) wherein the cam surface 40*a* pivotally pushes the input switching clutch plate 18. This pivotal movement of the input switching clutch plate 18 causes opening of the throttle valve 3 which enables the vehicle to run off the road. This transmission path defines the mechanical control transmission path 16. Even if the electromagnetic actuator 14 is operated in fault to pivotally move the transmission gear 30 through the motor gear 31, the transmission gear 30 is rotated without any adverse influence because of disengagement of the clutch teeth 28*a* and 28*b*.

Figure 8:
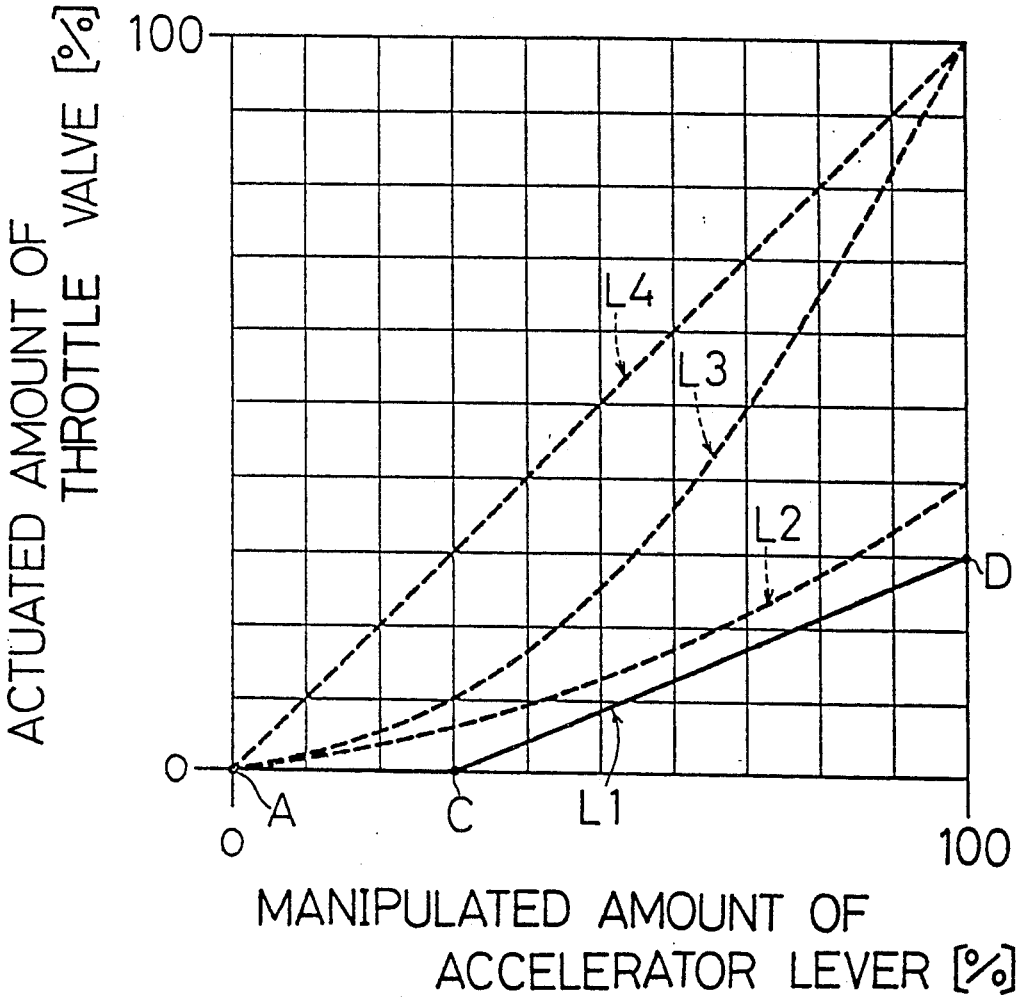
FIG. 8 is a graph representing characteristic lines of the relation between the manipulated amount of the accelerator pedal and actuated amount of the throttle valve.

The relation between the manipulated amount of the accelerator lever 37 and the actuated amount of the throttle valve is shown in a solid line L1 in FIG. 8. In FIG. 8, points A, C and D correspond to the positions FIGS. 7(*a*). 7(*c*) and 7(*d*), respectively. The characteristics shown in dotted lines in FIG. 8 can be easily obtained by changing the design as to the position of the interlocking pin 34 of the interlocking piece 33, the contour of the cam surface 40*a* of the interlocking lever 40, the ratio of the levers, and others.

In the throttle valve controller described above, the input switching clutch plate 18 of the switching means 13 is mounted on the throttle shaft 4 displaceably in the thrust direction, and displacement of the switching means 13 in the thrust direction by the switching actuator 23 permits selective connection of the transmission path 15 or 16, with no need of such a power transmitting mechanism including sheaves, cables or the like as required in the prior art.

As the input switching clutch plate 18 selectively connects either the mechanical control transmission path 16 or the electronic control transmission path 15, there is no possibility of interference in the valve drive system which would be caused by simultaneous connection of both transmission paths, so that no reaction force of the accelerator pedal and consequently no change in depressed force may occur.

FIGS. 9 to 14 show a second embodiment of the present invention.

Figure 9:
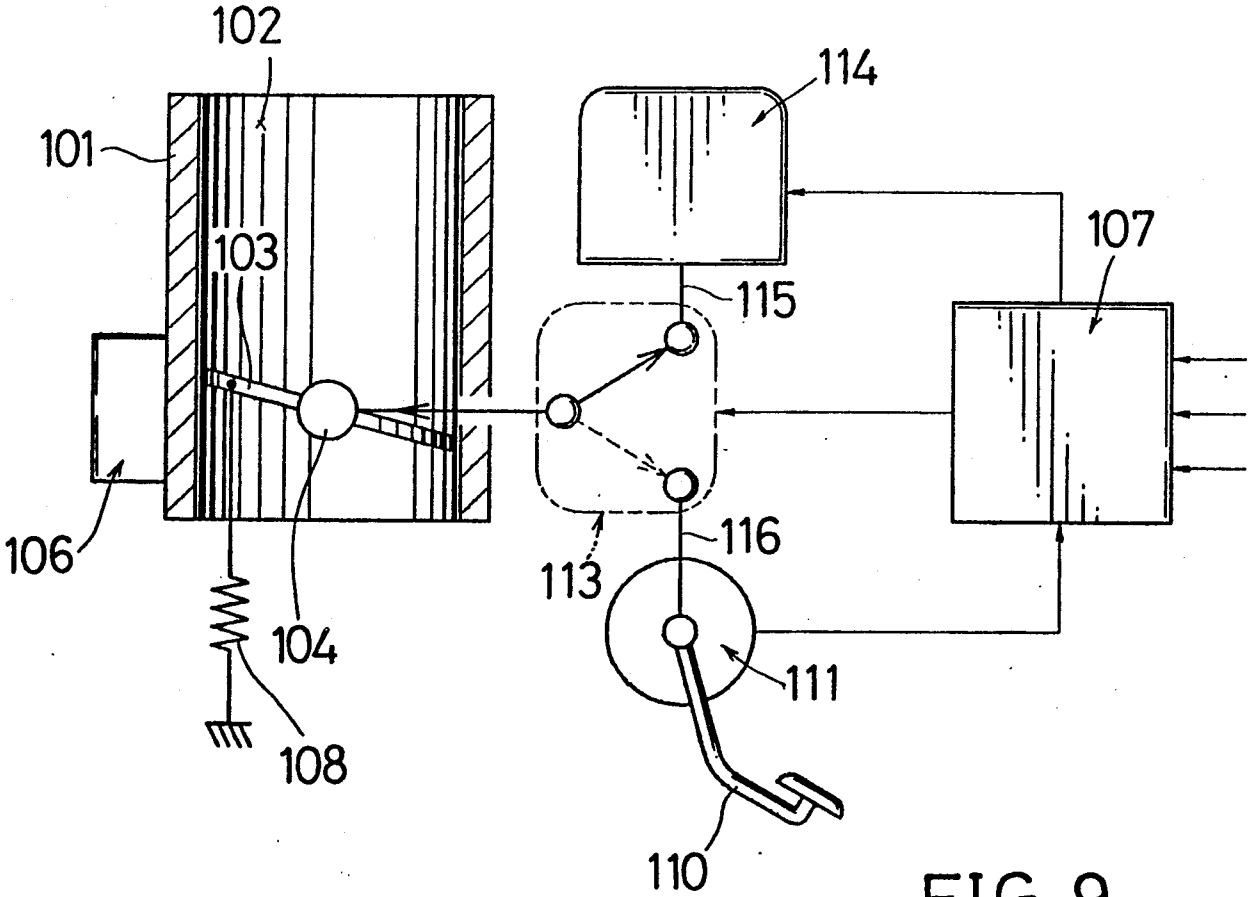
FIG. 9 is a schematic view of a throttle valve controller according to a second embodiment of the present invention.

As shown in FIG. 9, a throttle body 101 in an engine for a vehicle or the like is provided with a throttle valve 103 disposed therein for opening or closing an intake passage 102 so as to adjust the amount of intake air to the engine. The throttle valve 103 is affixed to a throttle shaft 104 having opposite ends pivotally movably supported by the throttle body 101.

A throttle sensor 106 is provided on a side (left side as viewed in FIG. 9) of the throttle body 101. The sensor 106 is adapted to detect the opening degree of the throttle valve 103 from the amount of pivotal movement of the throttle shaft 104, and to transmit a detection signal to a control circuit composed of an electronic control unit (ECU).

The throttle valve 103 is provided with a return spring 108 adapted to normally bias the throttle valve 103 to its closed position. Specifically, the throttle shaft 104 has an end (left end as viewed in FIG. 9) to which a throttle sensor lever 109 is attached so as to be engageable with a detecting element of the throttle sensor 106, and the return spring 108 is disposed in double layer between the lever 109 and the throttle body 101.

An accelerator pedal 110 is disposed on a floor of a driver's seat of the vehicle so as to be manipulated by depression. The depressed amount of the pedal 110 is detected by an accelerator sensor 111, and the detection signal is transmitted to the control circuit 107.

The throttle shaft 104 is connected at the other end thereof to an electromagnetic actuator 114 composed of a step motor through switching means 113.

The switching means 113 is adapted to selectively connect an electronic control transmission path 115 for transmitting driving force of the electromagnetic actuator 114 to the throttle shaft 104 or a mechanical control transmission path 116 for transmitting manipulated force of the accelerator pedal 110 to the throttle shaft 104. In the normal operating condition, it connects the electronic control transmission path 115 but disconnects the mechanical control transmission path 116. In the abnormal operating condition, it disconnects the electronic control transmission path 115 and connects the mechanical control transmission path 116 in response to a malfunction signal from the control circuit 107.

Figure 10:
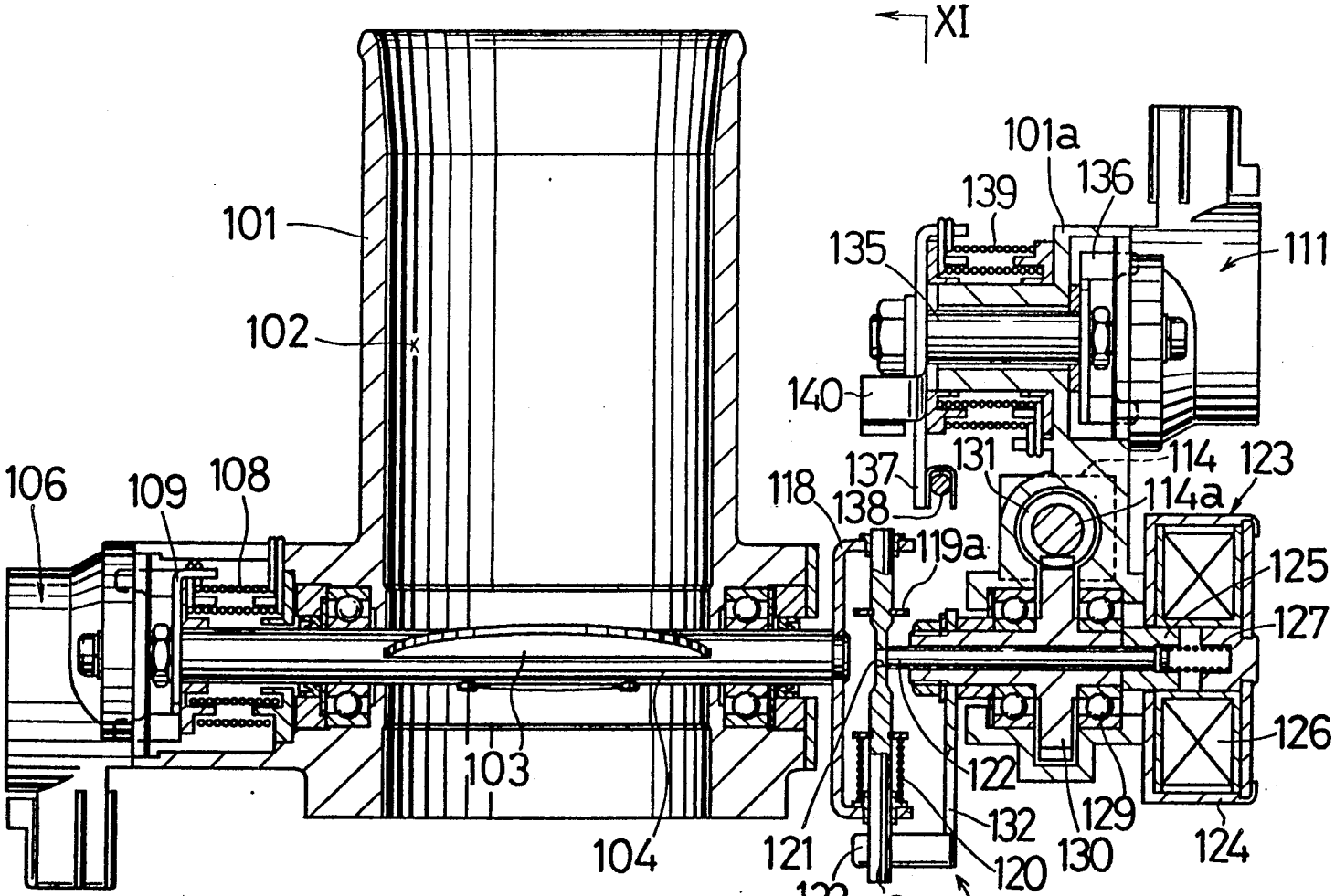
FIG. 10 is a sectional view showing the essential parts of the throttle valve controller of the second embodiment.
Figure 11:
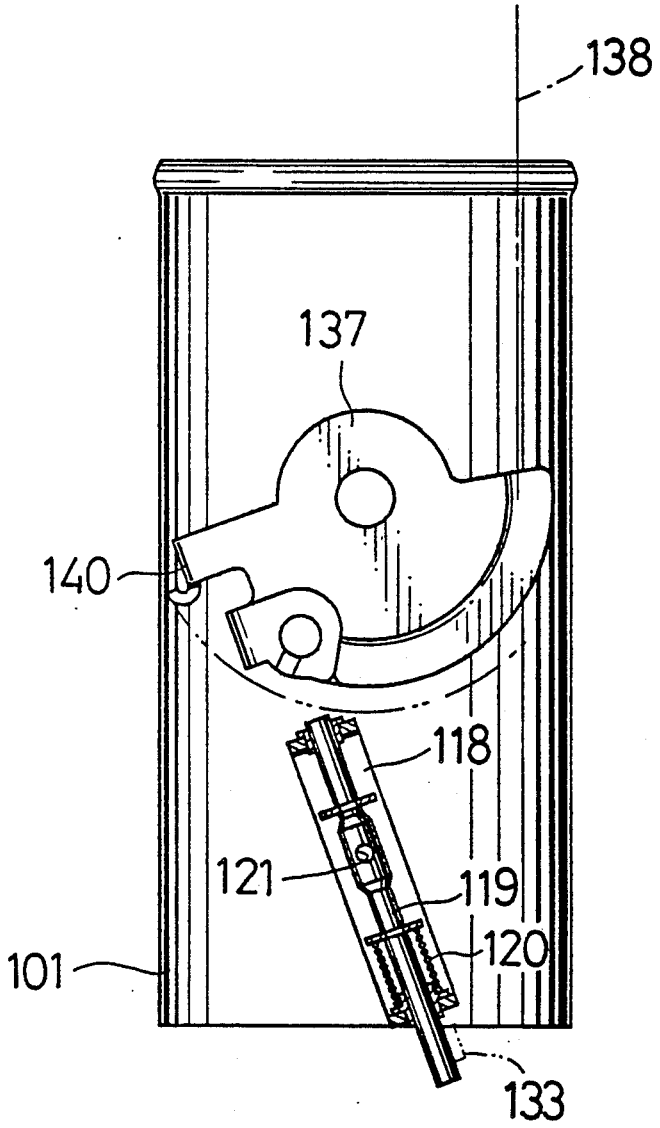
FIG. 11 is a side view taken along lines XI—XI in FIG. 10.
Figure 12:
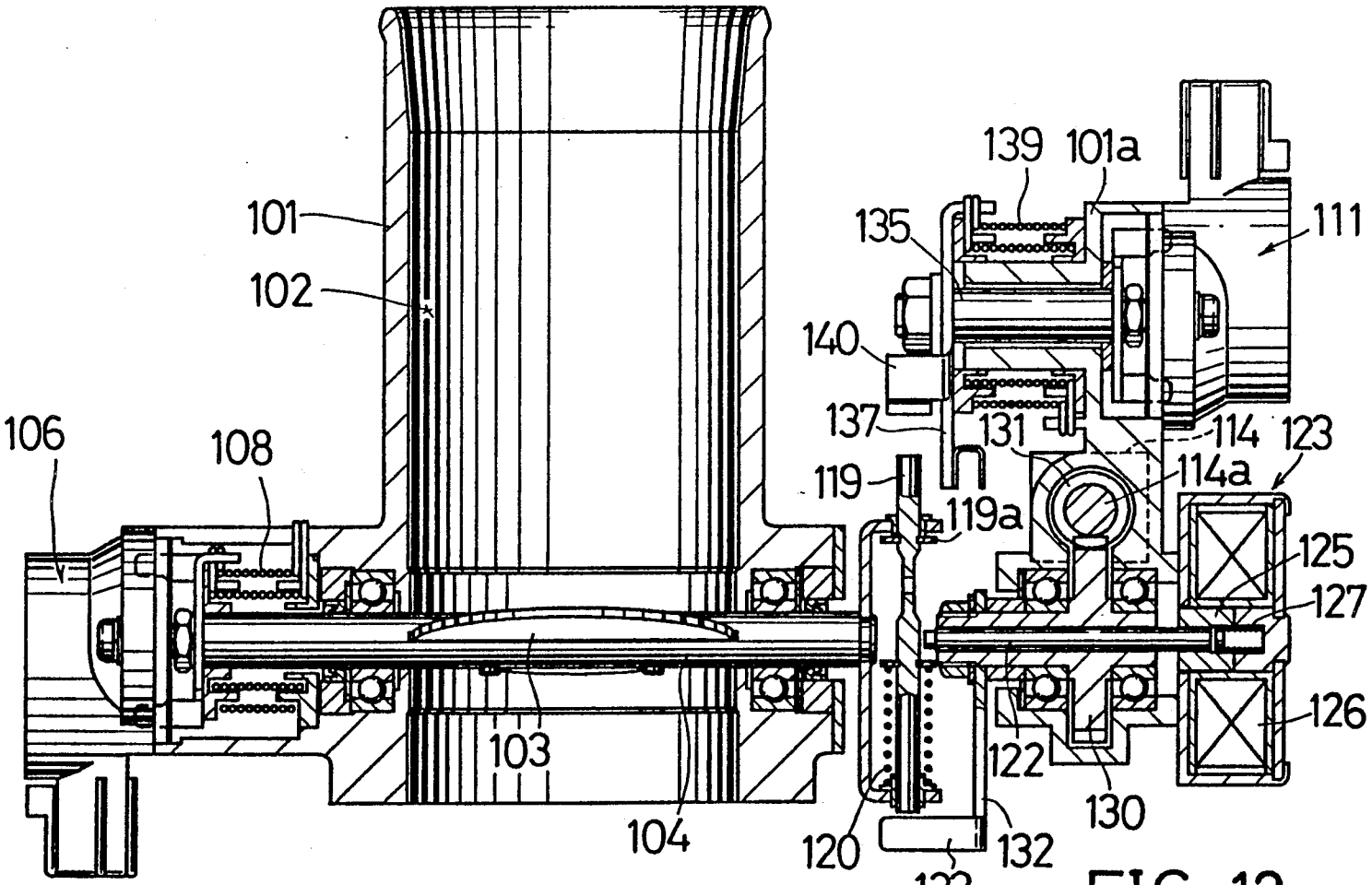
FIG. 12 is a view similar to FIG. 10 but in the abnormal operating condition.

Now, the switching means 113 will be described more in detail as to its construction. As shown in FIG. 10, a throttle lever 118 is attached to an end of the throttle shaft 104. A transmission rod 119 is supported at both ends thereof by the throttle lever 118 slidingly movably in the radial direction of the throttle shaft 104 and is biased in one direction (upwardly as viewed in FIG. 10) relative to the throttle lever 118 by a spring 120. The transmission rod 119 has at the central portion thereof a connecting hole 121, in which is received a distal end of a switching rod 122 which can be actuated by a solenoid 123. FIG. 11 is a side sectional view taken along lines XI—XI in FIG. 10.

As the switching rod 122 is engaged in the connecting hole 121 as shown in FIG. 10, the transmission rod 119 is kept in a position where the lower end thereof projects beyond a corresponding end of the throttle lever 118 against the biasing force of the spring 120.

The switching rod 122 has a proximal end coupled with a plunger 125 of the solenoid 123. The solenoid 123 is installed in an adapter **101*a* secured to the throttle body 101. The solenoid 123 includes a coil 126 in a case 124, and when there is no supply of electric power to the coil 126, or when it is not energized, the switching rod 122 is held in its projecting position by the biasing force of a spring 127 provided in the solenoid 123. When the coil 126 is energized, magnetic force is generated around the coil 126, causing the plunger 125 and consequently the switching rod 122 to be retracted against the biasing force of the spring 127**.

The switching rod 122 extends through a bore of a worm gear 130 rotatably and axially movably. The worm gear 130 is rotatably supported in the adapter **1*a* through bearings 129. The worm gear 130 is in mesh with a worm 131 formed on an output shaft 114*a* of the electromagnetic actuator 114. Thus, when the electromagnetic actuator 114 is activated, the worm gear 130 is rotated through the worm 131**.

An output lever 132 is mounted on the worm gear 130 at the end thereof adjacent to the throttle lever 118. The output lever 132 is formed at the distal end thereof with an interlocking piece 133 in such a position as to be engageable with the lower end of the transmission rod 119 (as viewed in the drawing), or more specifically with a side of the end in a direction opposite to the valve opening direction right side as viewed in FIG. 11).

As shown in FIG. 10, the adapter **101*a* further includes an accelerator sensor 111 adjacent to the solenoid 123, and a pivot shaft 135 rotatably supported and extending coaxially of the sensor 111. An accelerator sensor lever 136 engageable with a detecting element of the accelerator sensor 111 is attached to an end (right end as viewed in FIG. 10) of the pivot shaft 135**.

An accelerator lever 137 is attached to the other end (left end as viewed in FIG. 10) of the pivot shaft 135. An accelerator cable 138 extending from the accelerator pedal 110 is connected to the accelerator lever 137. A return spring 139 is provided in double layer between the accelerator lever 137 and the adapter **101*a* to normally bias the accelerator pedal 110 through the lever 137** in the returned direction.

The accelerator lever 137 is formed with an interlocking piece 140 which, in the regular driving condition, swings slightly above the upper end of the transmission rod 119 when the accelerator pedal 110 is manipulated by depression (See two-dot chain lines in FIG. 11).

The throttle valve controller of this construction operates as follows.

In the normal operating or regular driving condition, the switching means 113 is in the position as shown in FIG. 9. When the accelerator pedal 110 is not depressed, the throttle valve 103 is biased to its fully closed position by the return spring 108, as shown in FIG. 10, with the accelerator pedal 137 kept in its returned position under the biasing force of the return spring 139. In this condition, the transmission rod 119 is in engagement with the switching rod 122, so that it is positioned to be engageable with the interlocking piece 133 of the output lever 132.

In this condition, when the accelerator pedal 110 is depressed, the electromagnetic actuator 114 is energized in accordance with the control signal produced by the control circuit 107 in response to the depressed amount, and generates driving force which is sequentially transmitted through the worm 131, the worm gear 130, the output lever 132, the transmission rod **11*g* and the throttle lever 118 to the throttle shaft 104 to open or close the throttle valve 103. This transmission path defines the electronic control transmission path 115. The depressed force of the accelerator pedal 110 is also transmitted to the accelerator lever 137 through the accelerator cable 138 in FIG. 11, but, in this case, the lever 137, swings without engaging the transmission rod 119**.

If any malfunction occurs in the electromagnetic actuator 114, the control circuit 107 or others, the control circuit 107 transmits a malfunction signal. This causes the solenoid 123 of the switching means 113 to be activated to retract the switching rod 122. Thus, the switching rod 122 is disengaged from the connecting hole 121 of the transmission rod 119, and consequently moved upwardly (as viewed in the drawing) under the biasing force of the spring 120 to a position shown in FIGS. 12 and 13. At this time, a stopper **119*a* of the transmission rod 119 is brought in abutment against the end of the throttle lever 118 so as to limit movement of the rod 119**.

When the transmission rod 119 is moved as described above, the lower end of the rod is moved upwardly (as viewed in the drawing) from a position engageable with the interlocking piece 133 to a position out of engagement, with the upper end of the rod being in a position engageable with the interlocking piece 40 of the accelerator lever 137.

Figure 13:
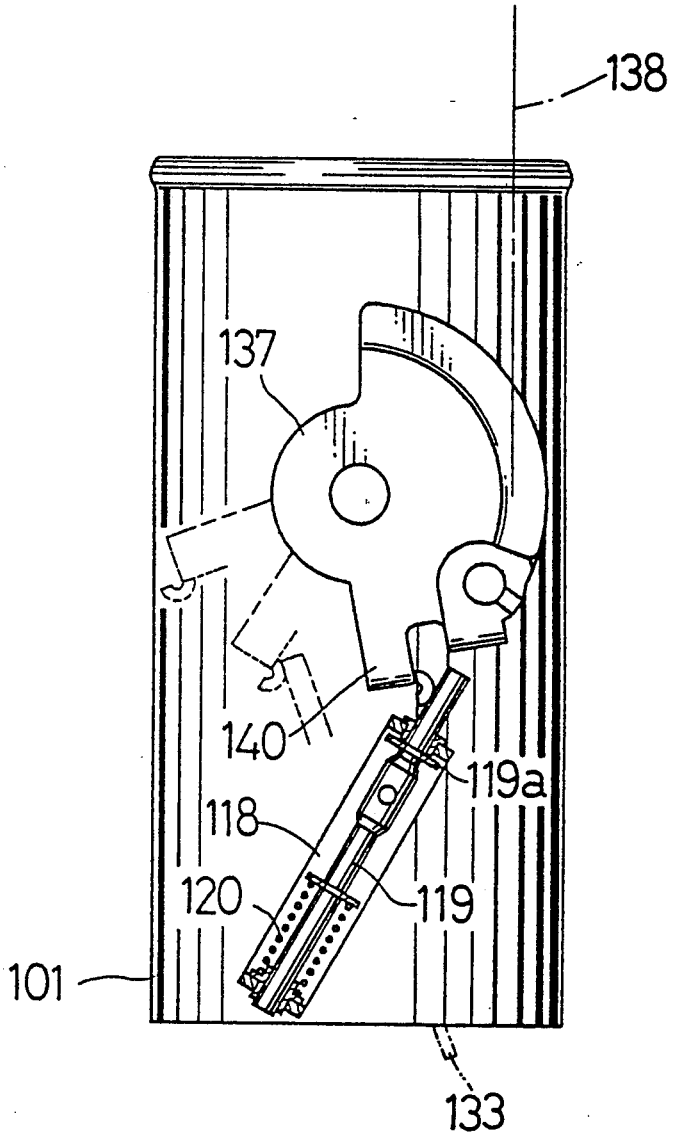
FIG. 13 is a view similar to FIG. 11 but in the abnormal operating condition

In this condition, when the accelerator pedal 110 is depressed, the accelerator lever 137 is pivotally rotated, as shown in FIG. 13, to bring the interlocking piece 140 in abutment against the upper end of the transmission rod 119, and then, the transmission rod 119 is pivotally moved along with the throttle lever 118. This pivotal movement of the throttle lever 118 is effective to control opening and closing of the throttle valve 103 which enables the vehicle to run off the road. This transmission path defines the mechanical control transmission path 116. Even if the actuator 114 is operated in fault to pivotally move the output lever 132, the lever 132 is out of engagement with the transmission rod 119.

Figure 14:
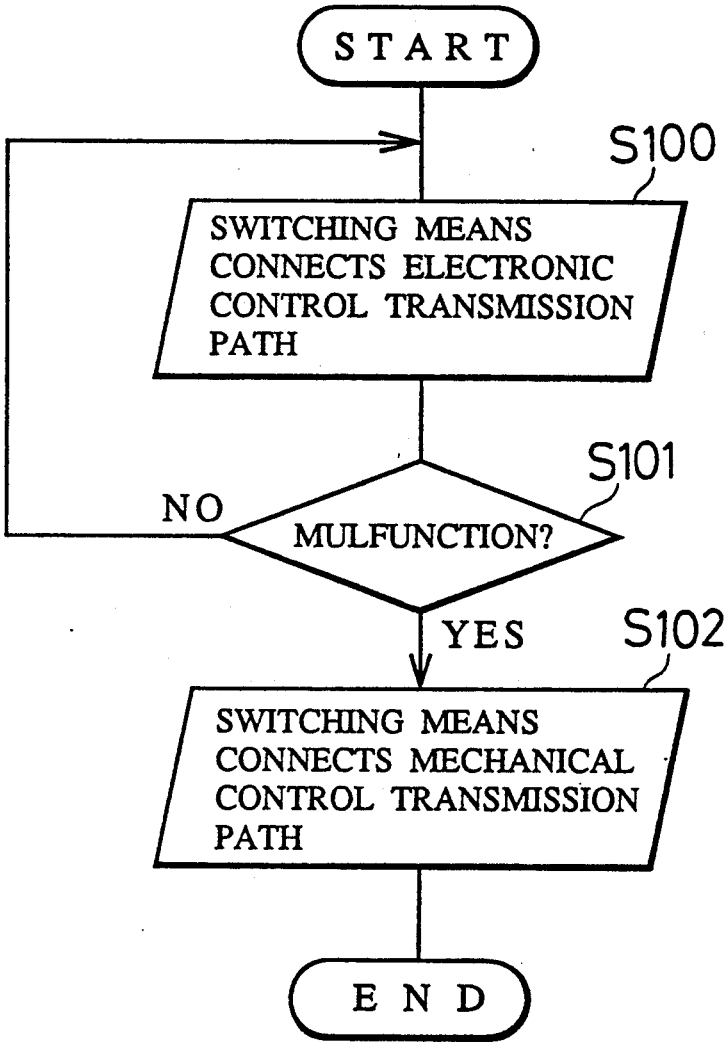
FIG. 14 is a flow chart of the process of the control circuit.

FIG. 14 is a flow chart illustrating the programming of the control circuit. Specifically, in Step S100, the switching means 113 connects the electronic control transmission path 115. Then, the program proceeds to Step S101 in which it is discriminated whether a malfunction is present or not. If there is no malfunction, the program returns to Step S100. If there is any malfunction, the program proceeds to Step S102 in which the switching means 113 connects the mechanical control transmission pat 116.

In the throttle valve controller of this embodiment, as the single switching means 113 can selectively connect either one of the two transmission paths 115 and 116, the controller can be simplified in construction and consequently reduced in cost in comparison with the prior art controller employing two switching means. Furthermore, any possible malfunction such as uncontrollability of the throttle valve 103 which would be caused by simultaneous connection of both transmission paths 115 and 116 in the prior art can be precluded, assuring high reliability.

Once the vehicle is put in the abnormal operating condition wherein the vehicle is permitted only to run off the road, the vehicle must be brought to a repair shop or the like for repair by reengaging the transmission rod 119 with the switching rod 122 or the like so as to restore the normal operating condition. Even if the control circuit 107 operates in fault t return to the normal operating condition during such escaping drive of the vehicle in the abnormal operation condition, the electronic control transmission path 115 is kept out of connection. Thus, once any malfunction occurs, the ordinary user is obliged to order repair and maintenance of the vehicle in the repair shop, so that he can avoid any possible dangerous driving of the vehicle permitted by faulty operation of the control circuit 107 to return to the normal operating condition.

FIGS. 15 to 18 show a third embodiment of the present invention. As this embodiment includes a modification in part of the switching means 113 of the second embodiment, the modified parts will be described in detail, but the other parts which are believed to be the same as or equivalent to the corresponding parts of the second embodiment are designated with the same reference numbers and any duplicated description as to them will be omitted. In the same way, any duplicated description will be also omitted in a further subsequent embodiment.

Figure 15:
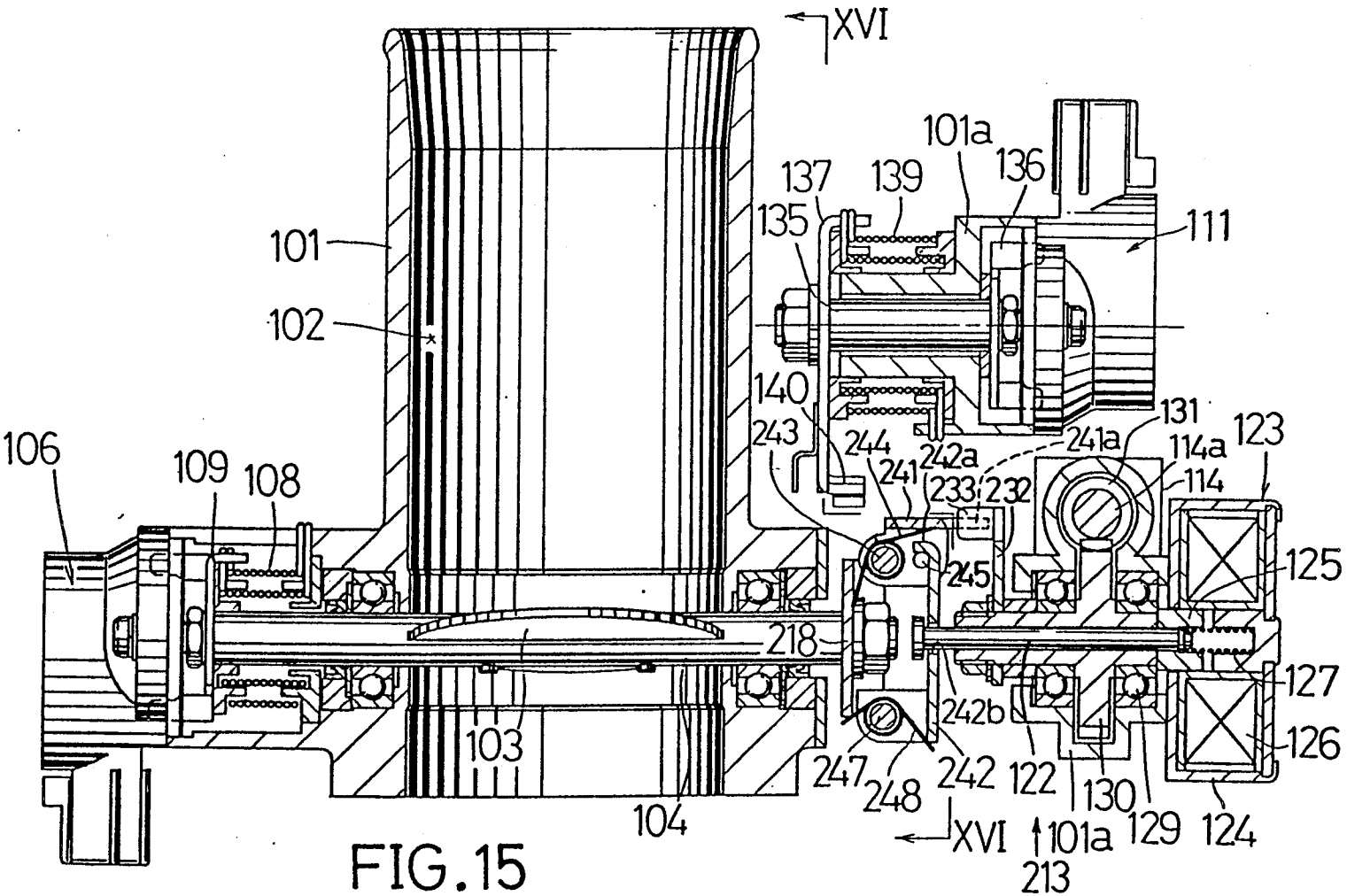
FIG. 15 is a sectional view of a switching means in a third embodiment of the present invention.
Figure 16:
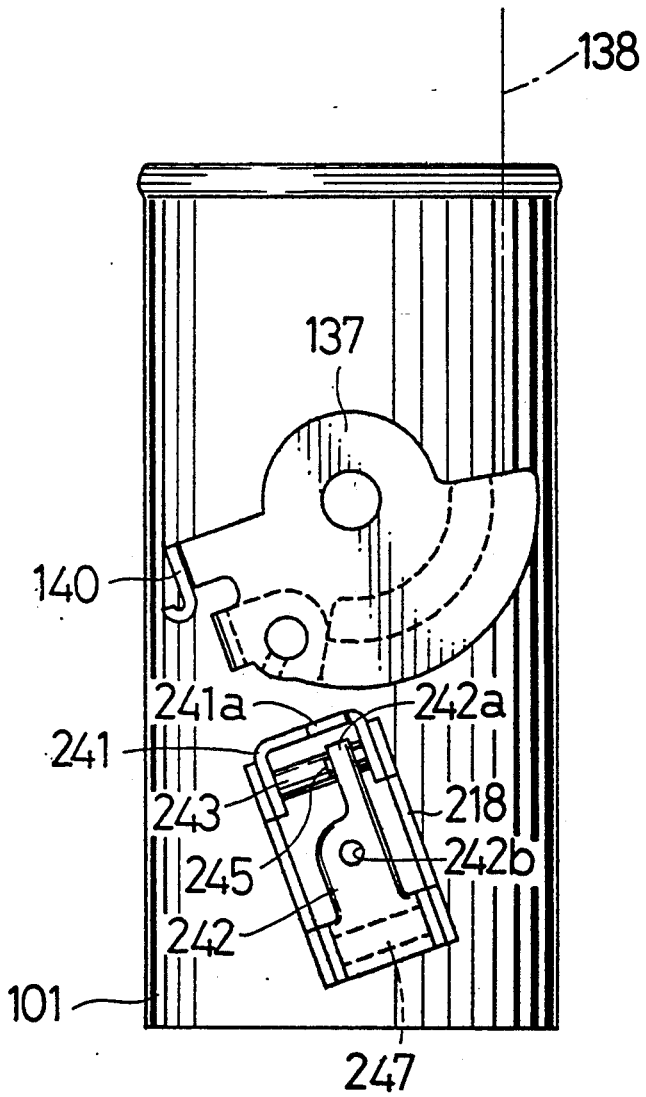
FIG. 16 is a side view taken along lines XVI—XVI in FIG. 15.
Figure 17:
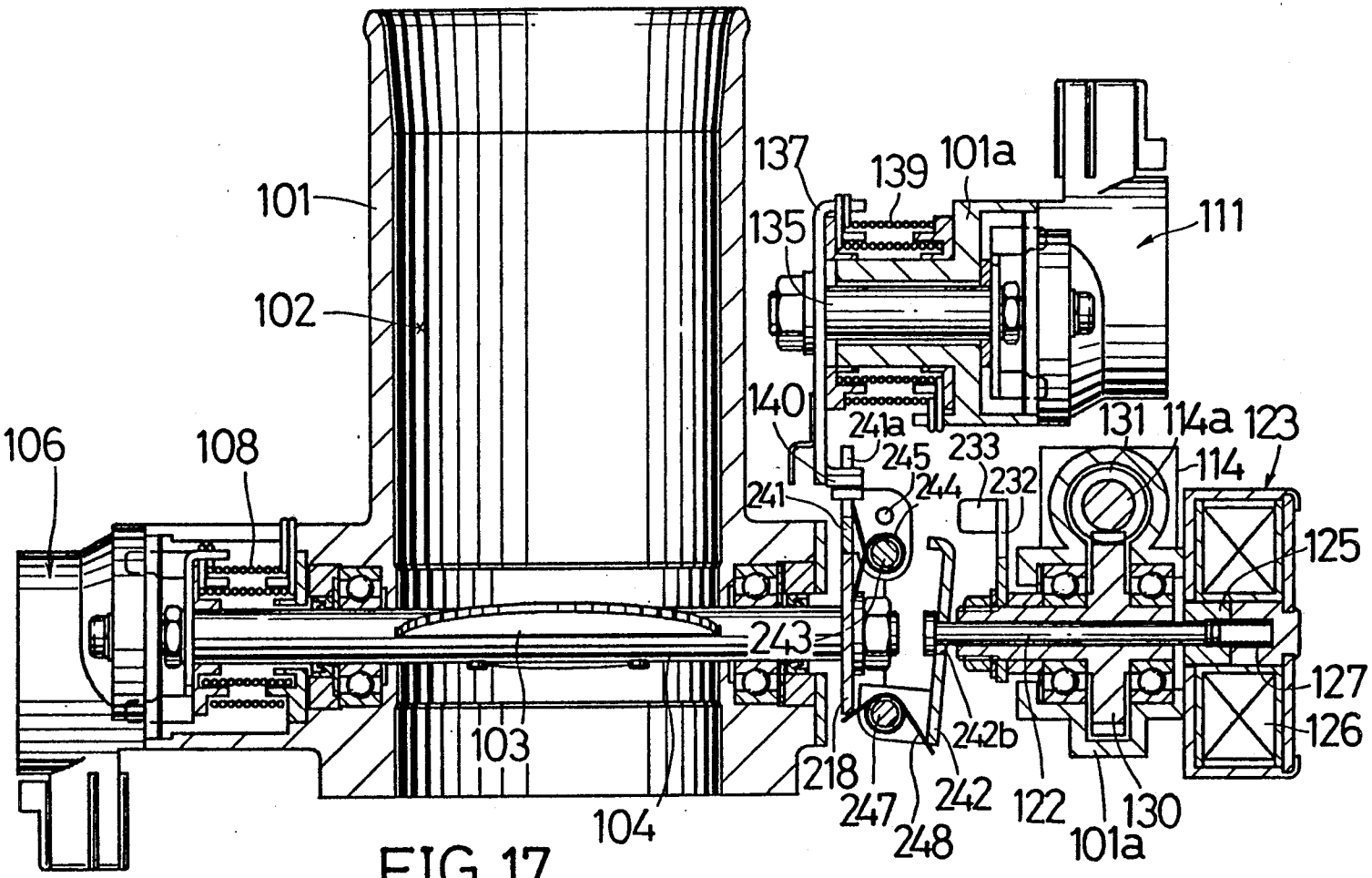
FIG. 17 is a view similar to FIG. 15 but in the abnormal operating condition.
Figure 18:
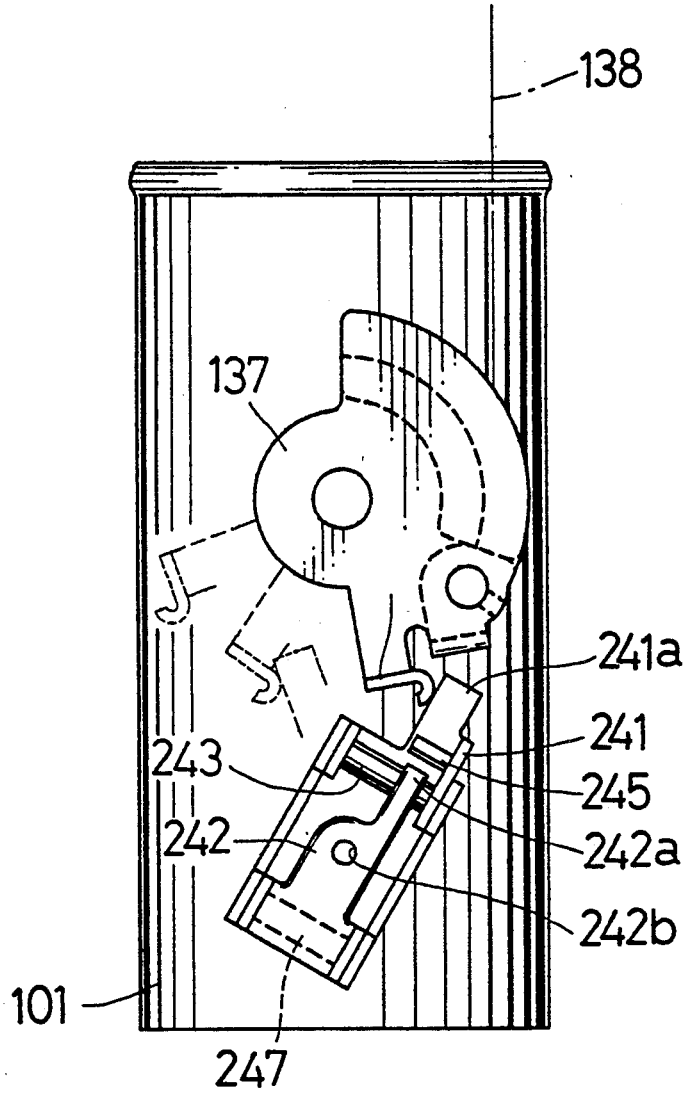
FIG. 18 is a view similar to FIG. 16 but in the abnormal operating condition.

FIG. 15 is a sectional view of a switching means 213 of the third embodiment, and FIG. 16 is a side sectional view taken along lines XVI—XVI in FIG. 15. FIGS. 17 and 18 correspond to FIGS. 15 and 16, respectively but illustrate the abnormal operating condition.

In this embodiment, a transmission lever 241 and a lock lever 242 are employed in place of the transmission lever 119 in the second embodiment. Specifically, as shown in FIGS. 15 and 16, a throttle lever 218 has an end (upper end as viewed in FIG. 15) to which the transmission lever 241 having an engaging piece **241*a* is pivotally movably attached through a pin 243. The transmission lever 241 is biased in one direction (counterclockwise direction as viewed in FIG. 15) by a spring 244. The transmission lever 241 is provided with a lock pin 245 adjacent to the engaging piece 241*a***.

The throttle lever 218 has the other end (lower end as viewed in FIG. 15) to which a lock lever 242 with a hook piece **242*a* formed at the distal end thereof is pivotally movably attached through a pin 247. The lock lever 242 is biased in one direction (counterclockwise direction as viewed in FIG. 15) by a spring 248. The lock lever 242 has at the central portion thereof a connecting hole 242*b*, in which is received a distal end of the switching rod 122. When the hook piece 242*a* is engaged with the lock pin 245 of the transmission lever 241, the transmission lever 241 is held against the biasing force of the spring 244 in such a position that the engaging piece 241*a* is engageable with an interlocking piece 233 of an output shaft 232**.

The switching means 213 of the third embodiment operates as follows.

In the normal operating or regular driving condition, the switching means 213 is in the position as shown in FIGS. 15 and 16. In this condition, as the engaging piece **241*a* of the transmission lever 241 is positioned to be engageable with the interlocking piece 233 of the output lever 232, pivotal movement of the output lever 232 can be transmitted through the transmission lever 242 to the throttle lever 218, and thus, the electronic control transmission path 115** is connected.

In the abnormal operating condition, the solenoid 123 is energized to retract the switching rod 122, so that the lock lever 242 is pivotally moved around the pin 247 against the biasing force of the spring 248, and consequently the lock pin 245 of the transmission lever 241 is disengaged from the hook piece **242*a*. Then, the transmission lever 241 is pivotally moved in the counterclockwise direction as viewed in FIG. 15 under the biasing force of the spring 244 to a position shown in FIG. 17. This pivotal movement of the transmission lever 241 is limited by abutment between respective abutting end surfaces of the lever 241 and the throttle lever 218**.

As the transmission lever 241 is pivotally moved, the engaging piece **241*a* of the lever 241 is brought in such a position as to be engageable with the interlocking piece 140 of the accelerator lever 137, so that the pivotal movement of the accelerator lever 137 can be transmitted through the transmission lever 241 to the throttle lever 218, as shown in FIG. 18 and thus, the mechanical control transmission path 116** is connected.

Figure 19:
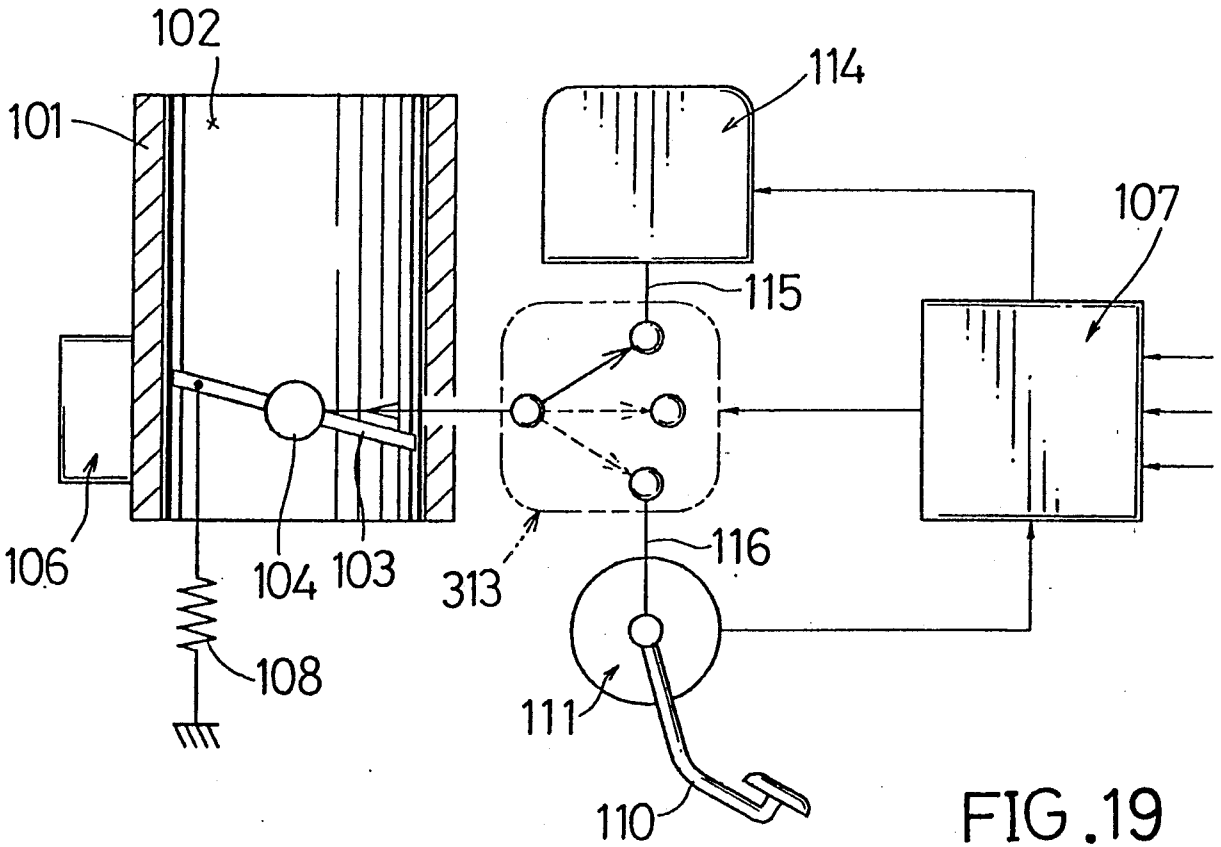
FIG. 19 is a schematic view of a throttle valve controller according to a fourth embodiment of the present invention.
Figure 20:
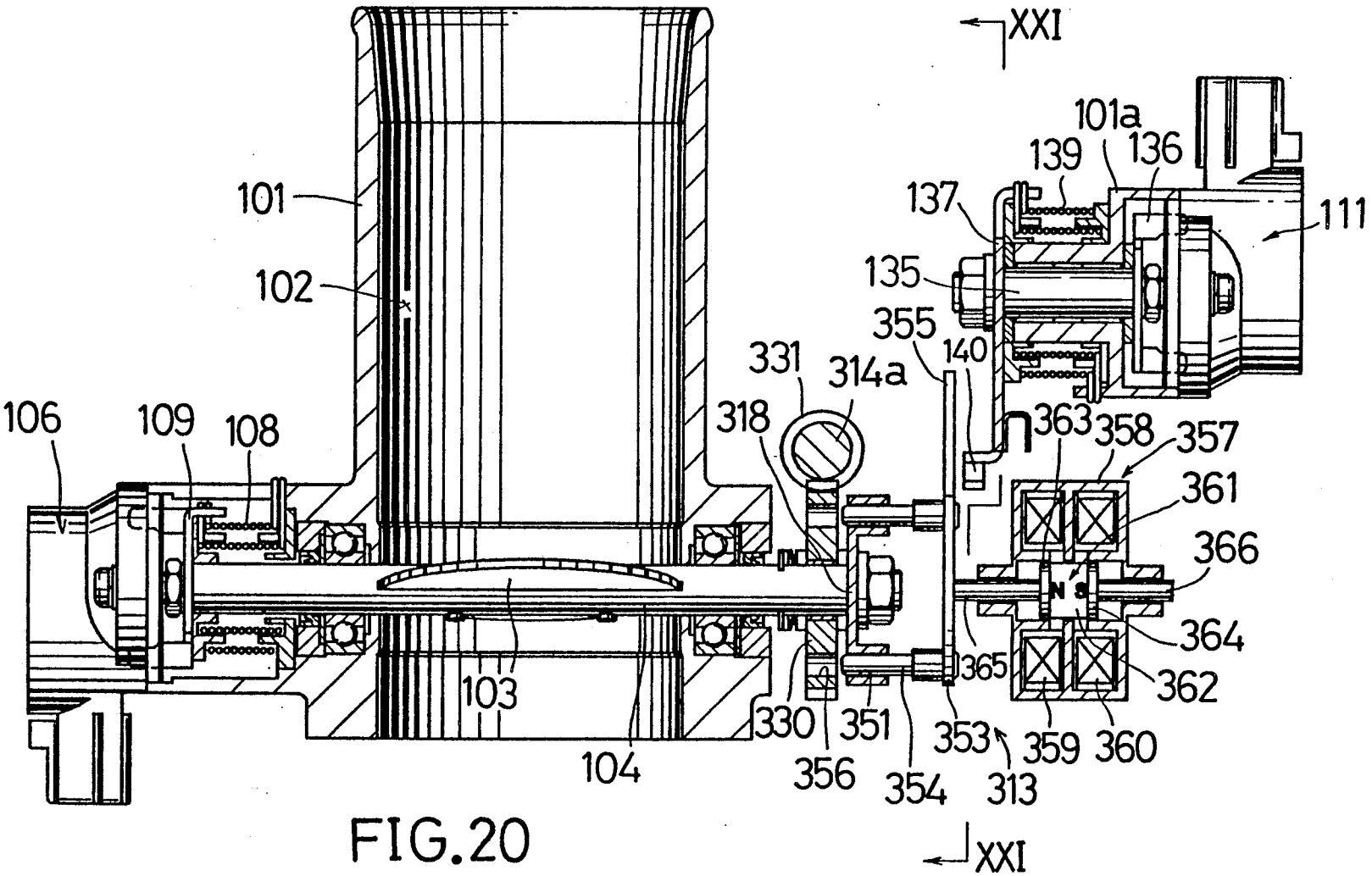
FIG. 20 is a sectional view of the switching means in FIG. 19.
Figure 21:
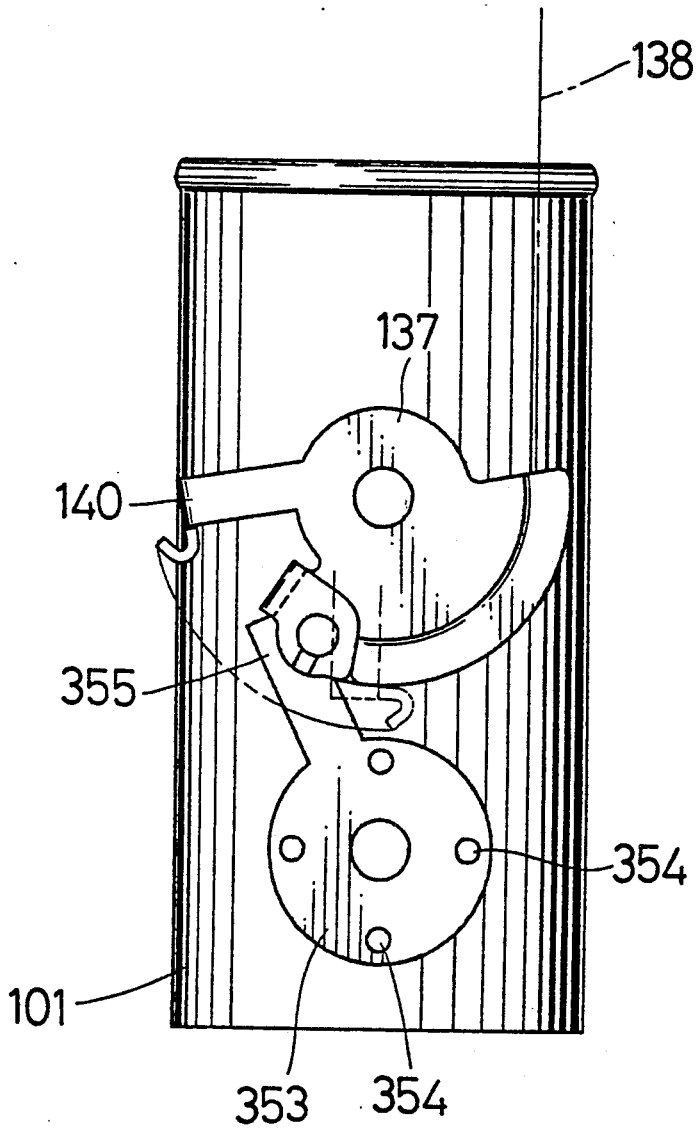
FIG. 21 is a side view taken along lines XXI—XXI in FIG. 20.
Figure 22:
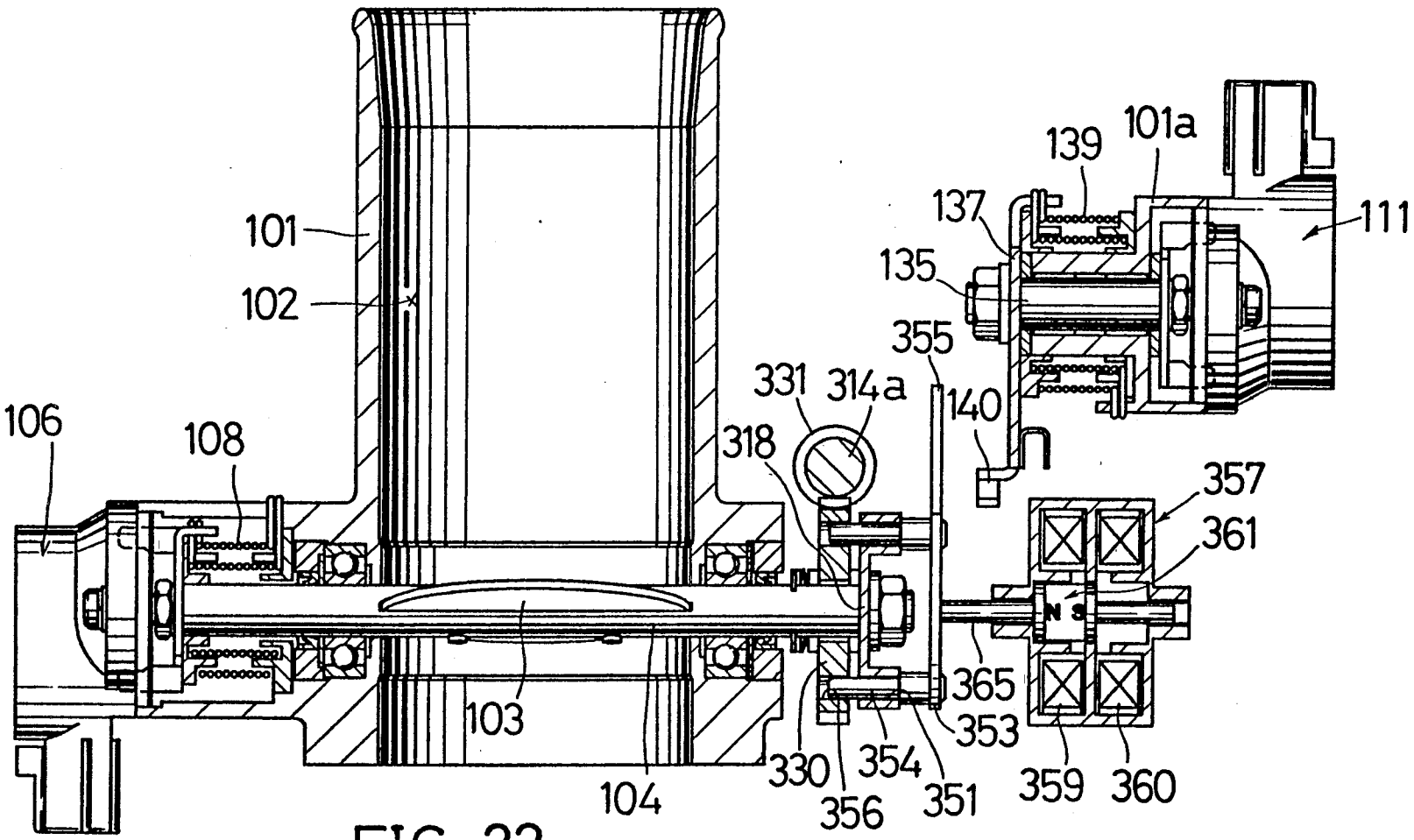
FIG. 22 is a view similar to FIG. 20 in the normal operating condition.

FIGS. 19 shows a fourth embodiment of the present invention much the same as that of FIG. 9. The difference in the fourth embodiment is that the switching means 113 of the second embodiment is modified. In FIG. 19, a switching means 313 has three switching positions including a first position wherein one of the transmission paths 115 and 116 is connected, a second position wherein the other is connected and a neutral position wherein both of the transmission paths 115 and 116 are simultaneously disconnected. When the engine is started, this switching means 313 is set to the neutral position and then connects the electronic control transmission path 115. Now, the switching means 313 will be described in detail as to its construction. FIG. 20 is a sectional view of the switching means 313, and FIG. 21 is a side sectional view taken along lines XXI—XXI in FIG. 20. FIG. 22 corresponds to FIG. 20 in the normal operating condition, and FIGS. 23 and 24 correspond to FIGS. 20 and 21, respectively but illustrate the abnormal operating condition.

As shown in FIG. 20, a throttle lever 318 attached to the end of the throttle shaft 104 has a proper number of guide holes 351 arranged along the periphery thereof. A worm gear 330 is rotatably supported on the throttle shaft 104 adjacent to the side of the throttle lever 318 facing to the throttle body 101, axial movement of the worm gear 330 being limited. The worm gear 330 is in mesh with a worm 331 formed on an output shaft 314*a* of the electromagnetic actuator. The worm gear 330 has engaging holes 356 formed in alignment with the guide holes 351.

An interlocking plate 353 of a disc type is arranged in parallel to the throttle lever 318 and has lock pins 354 inserted through the corresponding guide holes 351. The plate 353 is provided with an engaging piece 355 projecting from the outer periphery thereof. The interlocking plate 353 is fixed to the distal end of an actuation rod 365 of a solenoid 357.

The solenoid 357 is a linear solenoid different from the one employed in the second or third embodiment. The linear solenoid 357 comprises a first coil 359 and a second coil 360 housed in a case 358 and wound in the same direction, and an armature axially movably disposed in the coils 359. 360 and composed of a magnet 362 and magnetic plates 363, 364 coupled with opposite end surfaces of the magnet 362. The actuation shaft 365 is coupled with one of the magnetic plates 363, and a guide shaft 366 is coupled with the other magnetic plate 364. The case 358 and the magnetic plates 363, 364 are made of a magnetic material, while the actuation shaft 365 and the guide shaft 366 are made of a nonmagnetic material.

When both of the coils 359, 360 of the linear solenoid 357 are energized, the armature 361 is put in the neutral position, and then after both coils 359, 360 are deenergized, the armature 361 is kept in the position. When only the first coil 359 is energized, magnetic force generated thereby drives the actuation shaft 365 to the left as viewed in the drawing from the neutral position, and then after the first coil 359 is deenergized, it is kept in the position. When only the second coil 360 is energized, magnetic force generated thereby causes the actuation shaft 365 to be retracted to the right (as viewed in the drawing) from the neutral position, and after the coil 360 is deenergized, it is kept in the position.

The accelerator lever 137 is disposed adjacent to the interlocking plate 353, and in the regular driving condition, when the accelerator pedal is manipulated by depression, it swings aside the interlocking plate 353 without engaging the plate 353 (See FIGS. 20 and 21). When the solenoid 357 is activated to retract the interlocking plate 353, the engaging piece 355 of the interlocking plate 353 is brought in such a position as to be engageable with the interlocking piece 140 of the accelerator lever 137.

The throttle valve controller of the fourth embodiment operates as follows.

When the engine is started (i.e the ignition switch is turned on), the switching means 313 is in the neutral position shown in FIGS. 20 and 21. This neutral position is established by simultaneously energizing both of the coils 359 and 360 of the linear solenoid 357, and thus the switching means 313 is initialized.

Thereafter, when the second coil 360 of the linear solenoid 357 is deenergized and only the first coil 359 is energized, the actuation shaft 365 moves forward, so that the lock pins 354 of the interlocking plate 353 are inserted into the engaging holes 356 of the worm gear 330, as shown in FIG. 22. This allows rotation of the worm 331 to be transmitted through the worm gear 330 to the throttle lever 318, and thus, the electronic control transmission path 115 is connected. Though the first coil 359 is deenergized after connection of the transmission path 115, the linear solenoid 357 is kept in the position.

When the engine is stopped (i.e. the ignition switch is turned off), both of the coils 359, 360 of the linear solenoid 357 are again energized simultaneously to establish the neutral position similarly. Though the simultaneous energization ceases, the linear solenoid 357 is kept in the position.

Figure 23:
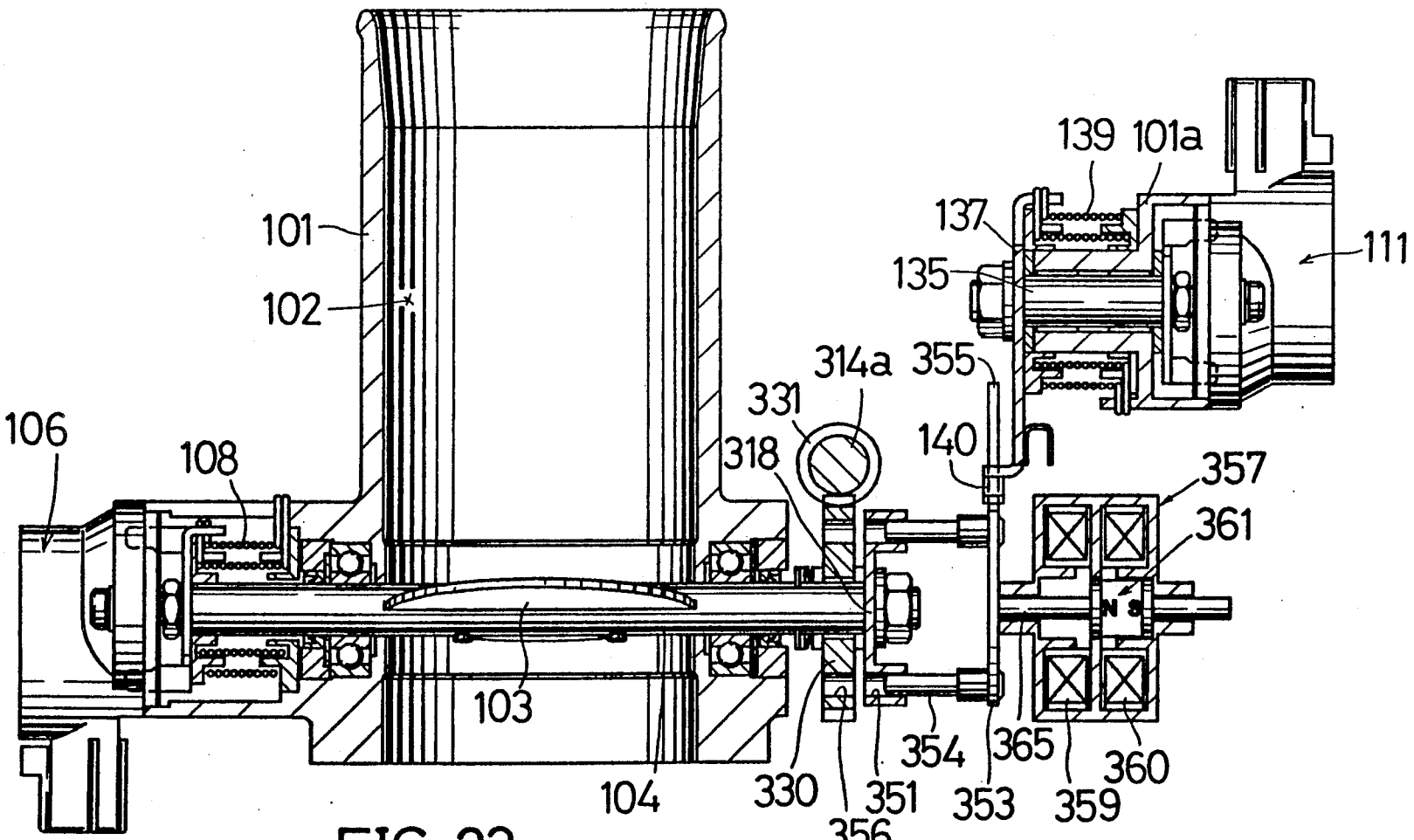
FIG. 23 is a view similar to FIG. 20 but in the abnormal operating condition.
Figure 24:
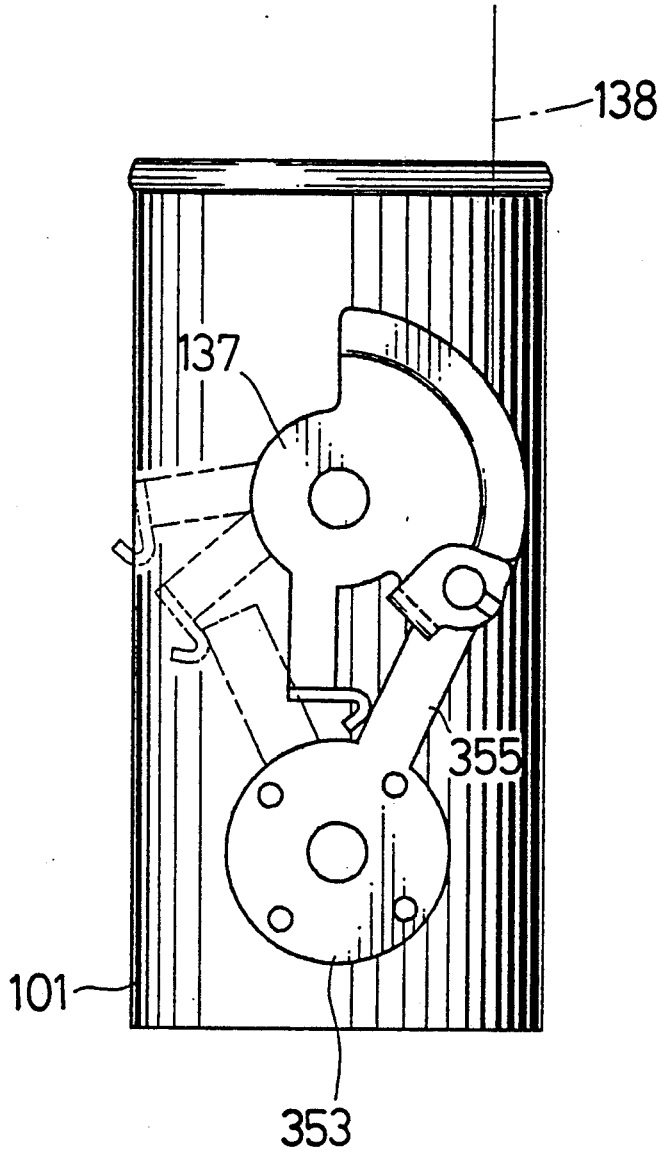
FIG. 24 is a view similar to FIG. 21 but in the abnormal operating condition.

If any malfunction occurs during running of the engine, the control circuit 107 transmits a malfunction signal. In response to the malfunction signal, the second coil 360 of the linear solenoid 357 is energized. This causes the actuation shaft 365 to be retracted, so that the lock pins 354 of the interlocking plate 353 are removed from the engaging holes 356 of the worm gear 330, as shown in FIG. 23. Thus, the electronic control transmission path is disconnected. At this time, the engaging piece 355 of the interlocking plate 353 is brought to such a position as to be engageable with the interlocking piece 140 of the accelerator lever 137. This permits rotation of the accelerator lever 137 to be transmitted through the transmission lever 355 and the interlocking plate 353 to the throttle lever 318. Thus, the mechanical control transmission path 116 is connected. Though the second coil 360 is deenergized after connection of the transmission path 116, the linear solenoid 357 is kept in the position.

Figure 25:
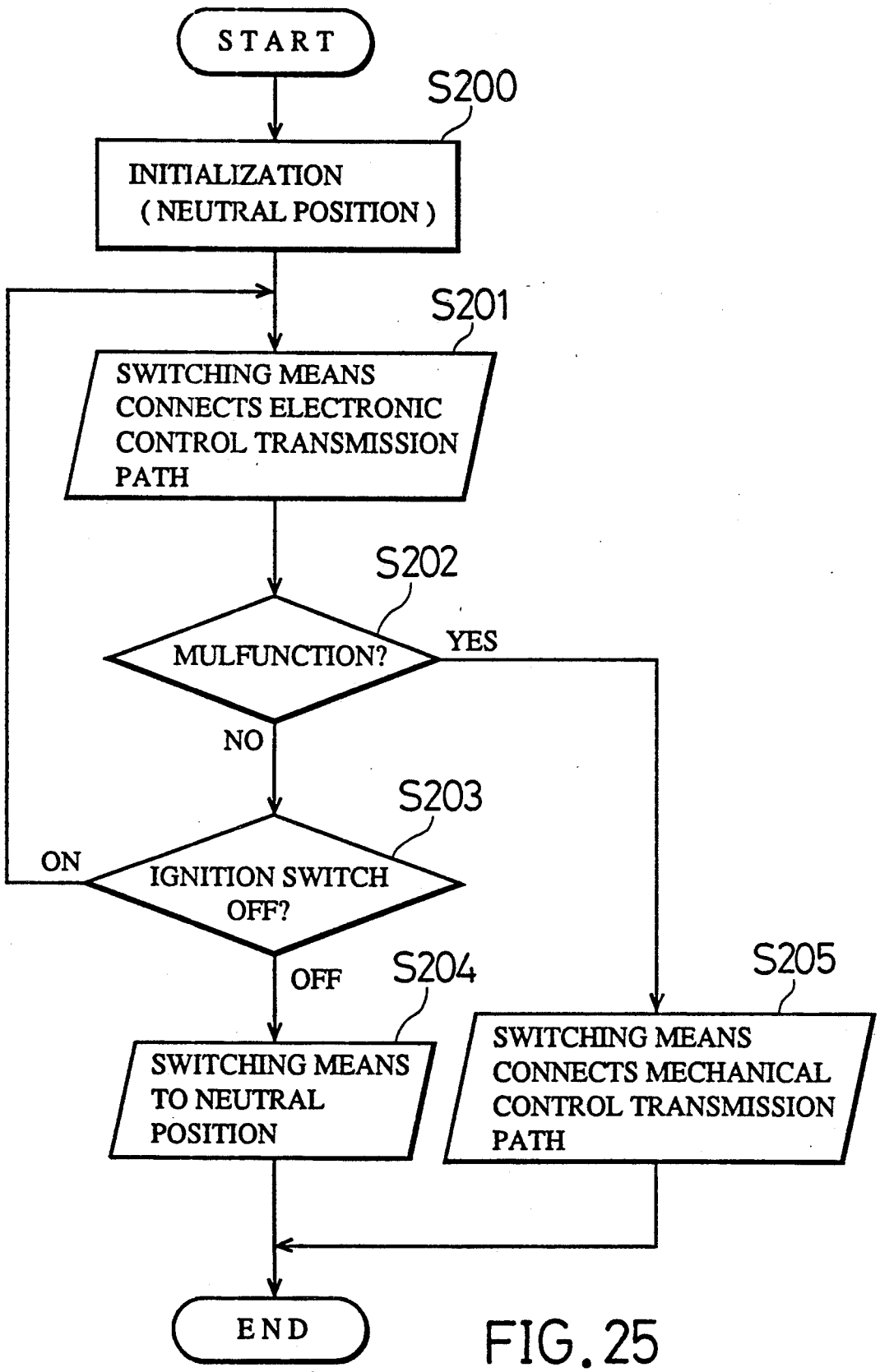
FIG. 25 is a flow chart of the process of the control circuit.
Figure 26:
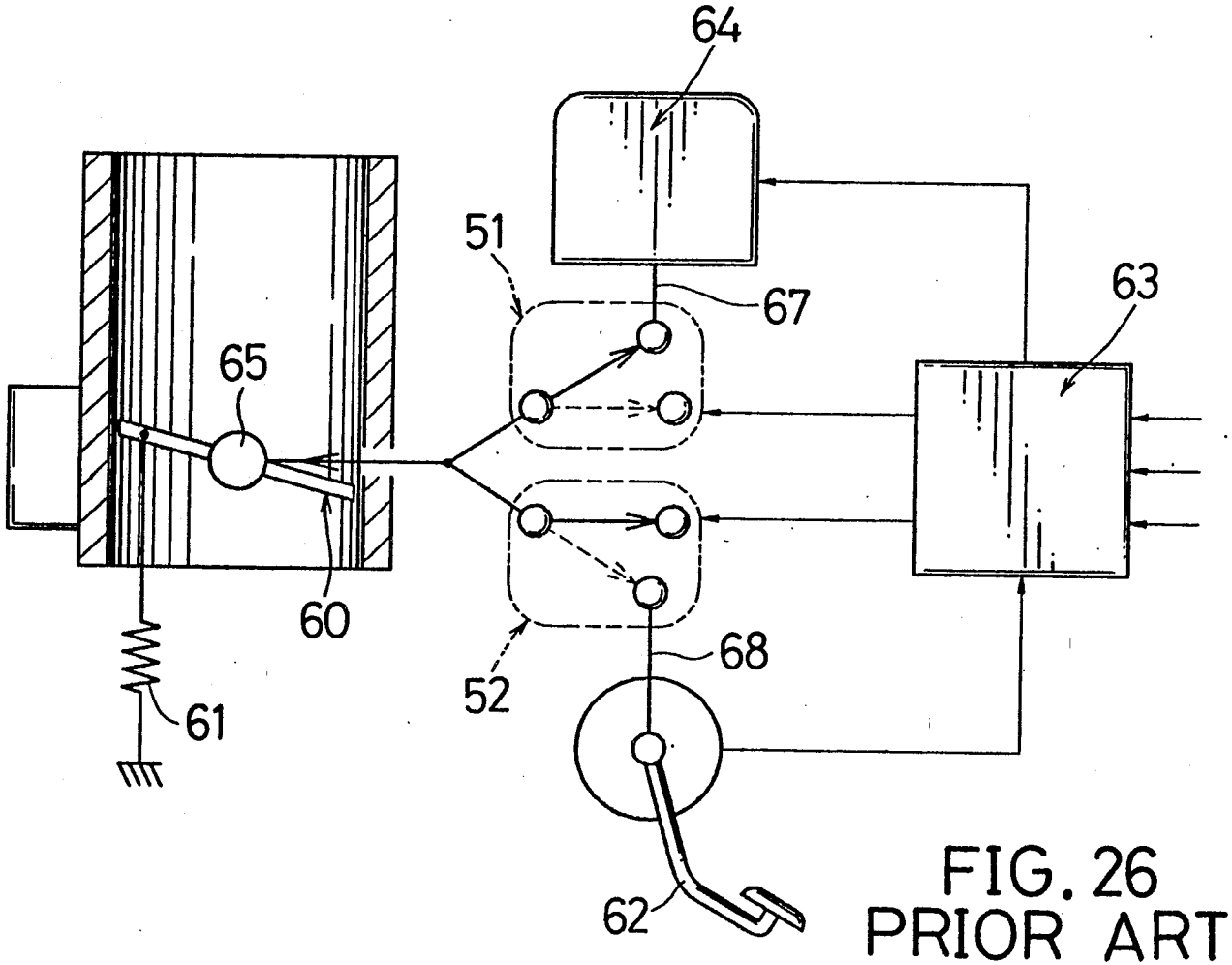
FIG. 26 PRIOR ART
FIG. 26 is a schematic view of a prior art.
Figure 27:
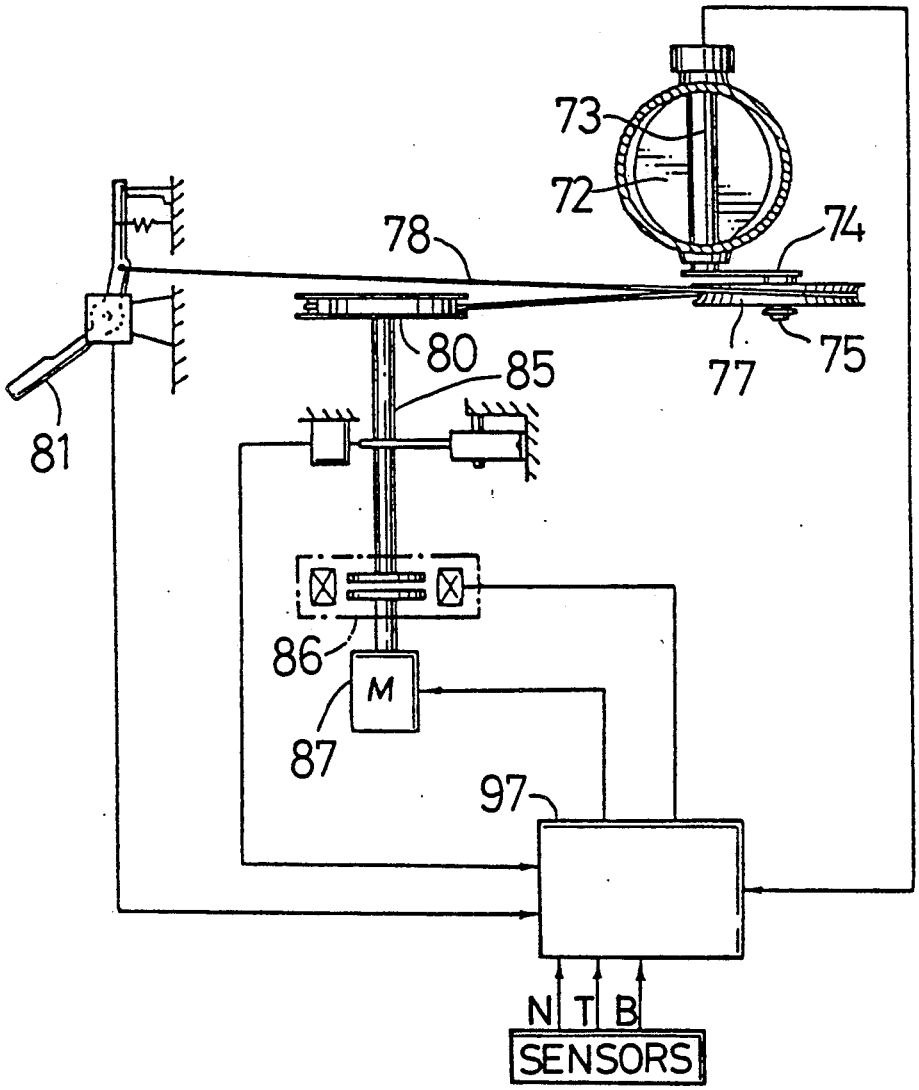
FIG. 27 PRIOR ART
FIG. 27 is a schematic view of another prior art.

FIG. 25 is a flow chart illustrating the programming of the control circuit. Specifically, when the engine is started, in Step S200, the switching means 313 is initialized to the neutral position by simultaneous energization of both coils. The program proceeds to Step S201 in which the switching means 313 connects the electronic control transmission path, and in Step S202, it is discriminated whether a malfunction is present or not. If there is no malfunction, the program proceeds to Step S203, in which the position of the ignition switch is discriminated. If the ignition switch is kept on, the program returns to Step S201. If the ignition switch is turned off, the program proceeds to Step S204, in which the switching means 313 is put in the neutral position by simultaneous energization of both coils. If it is discriminated that there is any malfunction in Step S202, the program proceeds to Step S205 in which the switching means 313 connects the mechanical control transmission path.

In the throttle valve controller for an engine of the above embodiment, actuation of the switching means 13A can be assured when the engine is started, which can remarkably improve reliability.

While the invention has been described with reference to preferred embodiments thereof, it is to be understood that modifications or variations may be easily made without departing from the scope of the present invention which is defined by the appended claims.

What is claimed is:

1. A throttle valve controller for an engine comprising:

a throttle valve pivotally movable along with a throttle shaft in an intake passage of the engine;

an electronic control transmission path for transmitting input torque to the throttle shaft;

an electromagnetic actuator for applying torque to the electronic control transmission path;

a mechanical control transmission path for transmitting manipulation force of an accelerator pedal to the throttle shaft; and switching means for connecting one of the electronic control and mechanical control transmission paths and disconnecting the other.

2. The throttle valve controller as defined in claim 1, wherein the switching means has three positions including a first position wherein one of the transmission paths is connected, a second position wherein the other is connected and the other position wherein both of the transmission paths are simultaneously disconnected.

3. The throttle valve controller as defined in claim 1, wherein the electronic control and mechanical control transmission paths are disposed coaxially of the throttle shaft, with a clutch plate provided axially displaceably therebetween; the switching means includes a solenoid for axially displacing the clutch plate; and the axial displacement of the clutch plate results in switching between a position wherein the electronic control transmission path is connected but the mechanical control transmission path is disconnected and a position wherein the electronic control transmission path is disconnected but the mechanical control transmission path is connected.

4. The throttle valve controller as defined in claim 1, wherein, so long as no malfunction signal is produced, the switching means connects the electronic control transmission path but the mechanical control transmission path is disconnected, and if a malfunction signal is produced, the switching means disconnects the electronic control transmission path but connects the mechanical control transmission path.

5. The throttle valve controller as defined in claim 4, wherein the switching means can switch from the electronic control transmission path to the mechanical control transmission path but cannot switch oppositely.

6. The throttle valve controller as defined in claim 3, wherein the clutch plate is mounted on the throttle shaft through a ball spline structure.

7. The throttle valve controller as defined in claim 6, wherein a shaft of the electromagnetic actuator, the throttle shaft and a shaft of an accelerator lever pivotally movable by manipulation force of the accelerator pedal are arranged in parallel to one another.

8. The throttle valve controller as defined in claim 7, wherein the clutch plate is biased in such a position wherein the electronic control transmission path is disconnected but the mechanical control transmission path is connected.

9. The throttle valve controller as defined in claim 7, wherein clutch reaction force of the clutch plate is set in a such direction that the electronic control transmission path is disconnected but the mechanical control transmission path is connected.

* * * * *